US005885371A

United States Patent [19]

Komatsubara et al.

[11] Patent Number: 5,885,371

[45] Date of Patent: Mar. 23, 1999

[54] METHOD OF PRODUCING GRAIN-ORIENTED MAGNETIC STEEL SHEET

[75] Inventors: Michiro Komatsubara; Toshito Takamiya; Kunihiro Senda; Mineo Muraki; Chizuko Goto; Mitsumasa Kurosawa; Kazuaki Tamura, all of Okayama, Japan

[73] Assignee: Kawasaki Steel Corporation, Japan

[21] Appl. No.: 947,641

[22] Filed: Oct. 9, 1997

[30] Foreign Application Priority Data

Oct. 11, 1996 [JP] Japan ..... 8-269688
Nov. 13, 1996 [JP] Japan ..... 8-301474

[51] Int. Cl.[6] ..... H01F 1/18

[52] U.S. Cl. ..... 148/113; 148/111

[58] Field of Search ..... 148/110, 111, 148/112, 113

[56] References Cited

U.S. PATENT DOCUMENTS 3,636,579 1/1972 Sakakura et al. ..... 148/111
3,933,024 1/1976 Matsumoto et al. ..... 72/364
3,990,923 11/1976 Takashina et al. ..... 148/111
4,000,015 12/1976 Malagari, Jr. ..... 148/112
4,319,936 3/1982 Dahlstrom et al. ..... 148/111
5,667,598 9/1997 Ozaki et al. ..... 148/111

FOREIGN PATENT DOCUMENTS 0 723 026 A1 7/1996 European Pat. Off. .

*Primary Examiner*—John Sheehan
*Attorney, Agent, or Firm*—Austin R. Miller

[57] ABSTRACT

A method of producing a grain-oriented magnetic steel sheet exhibiting a very low core loss and high magnetic flux density uses a slab of silicon steel containing Al, B, N, and S and/or Se. The method employs hot rolling conducted such that the rolling reduction falls within the range of from about 85 to 99%, and the hot-rolling finish temperature falls within the range of from 950° to 1150° C. and is based on the contents of Si, Al and B. The hot-rolled steel sheet is rapidly cooled at a cooling rate of about 20° C./s and is coiled at a temperature of about 670° C. or lower. Hot-rolled sheet annealing or intermediate annealing is executed by heating the hot-rolled steel sheet up to about 800° C. at a heating rate of from 5° to 25° C./s and holding at a temperature of from about 800° to 1125° C. for a period not longer than about 150 seconds. Final cold rolling is executed at a rolling reduction of from 80 to 95%, followed by final finish annealing conducted with specific control of annealing atmosphere.

24 Claims, 3 Drawing Sheets

METHOD OF PRODUCING GRAIN-ORIENTED MAGNETIC STEEL SHEET

BACKGROUND OF THE INVENTION

1. Field of the Invention

The present invention relates to a method of producing a grain-oriented magnetic steel sheet suitable for use as the material of a core of an electric machine such as a transformer, electric power generator or the like and, more particularly, to a method of producing a grain-oriented magnetic steel sheet which exhibits a high level of magnetic flux density, as well as very low level of core loss.

2. Description of Related Art

Si-containing grain-oriented magnetic steel sheets having (110) [001] crystal orientation or (100)[001] crystal orientation exhibit excellent soft magnetic properties and, hence, are widely used as cores of electric machines which operate under commercial electric power frequency. Grain-oriented magnetic steel sheets for such use are required to produce small core loss, which is generally expressed as $W_{17/50}$, which indicates the core loss produced when the steel sheet is magnetized to 1.7 T at a frequency of 50 Hz. The core loss produced by the core of a generator, transformer or the like can be remarkably reduced by using, as the material of the core, a grain-oriented magnetic steel sheet having a low value of $W_{17/50}$. Thus, there has been an increasing demand for the development materials having a smaller value of core loss $W_{17/50}$.

In general, methods are known for reducing the core loss of the core material, such enhancing electrical resistance by increasing the content of Si for reducing eddy currents, using thinner steel sheets, or by reducing crystal grain size, or by increasing magnetic flux density by enhancing the integrity of crystal grain orientation. The first-mentioned three methods were examined by the present inventors. The method which relies upon increased Si content has a practical limit in that an excessively large Si content impairs rolling characteristics and workability of the material. The method which uses thinner steel sheets also has a practical limit because it tremendously increases the costs of production.

Many studies and proposals have been made in regard to the method for reducing core loss through enhancement of magnetic flux density. For instance, Japanese Patent Publication No. 46-23820, entitled METHOD OF HEAT-TREATING HIGH MAGNETIC FLUX DENSITY MAGNETIC STEEL SHEETS, discloses a method in which Al-containing steel material is hot-rolled and then annealed at a temperature of from 1000° to 1200° C. and at a high temperature, followed by a quenching, so as to cause precipitation of fine AlN. Then, a final cold rolling is conducted at a large rolling reduction of 80 to 95%. It is said that the product steel sheet exhibits an extremely high magnetic flux density of 1.95 T at $B_{10}$. AlN which has been finely precipitated and dispersed serves strongly as an inhibitor of growth of primary recrystallization grains. By using this effect, the method permits secondary recrystallization to occur only on crystal nuclei having good orientation, whereby products having well oriented crystalline structure are obtained.

This method, however, tends to allow coarsening of the crystal grains, making it difficult to reduce core loss. In addition, it is not easy stably to obtain high magnetic flux density of the product, because of difficulty encountered in dissolving AlN in the course of annealing after hot rolling.

More specifically, this method essentially requires that finish cold rolling is conducted at a large rolling reduction of 80 to 95%, in order that the growth occurs only on a small number of nuclei which have good orientation, for the purpose of attaining high magnetic flux density. Therefore, the density of generation of secondary crystallization grains is reduced at the cost of achieving high magnetic flux density, with the result that the magnetic properties are rendered unstable due to coarsening of the crystal grains.

Various techniques have been proposed in regard to production of materials using AlN as an inhibitor. For instance, techniques which rely upon aging effected between successive cold-rolling passes are disclosed in Japanese Patent Publication No. 54-23647 entitled METHOD OF HIGH-GRADE UNI-DIRECTIONALLY ORIENTED MAGNETIC STEEL SHEET and Japanese Patent Publication No. 54-13846 entitled COLD ROLLING METHOD FOR PRODUCING HIGH MAGNETIC DENSITY UNI-DIRECTIONALLY ORIENTED SILICON STEEL SHEET HAVING EXCELLENT PROPERTIES. Attempts have been also made for stabilizing magnetic properties of the materials by using a warm-rolling technique, such as that disclosed in Japanese Patent Laid-Open No. 7-32006 entitled METHOD OF COLD-ROLLING GRAIN-ORIENTED SILICON STEEL SHEET AND ROLL COOLING DEVICE FOR COLD ROLLING MILL. These known methods, however, are still unsatisfactory in that they cannot stably provide products having high levels of magnetic flux density. Thus, the above-described problem regarding stability of products of excellent properties still remains unsolved.

Meanwhile, Japanese Patent Publication No. 58-43445, entitled METHOD OF PRODUCING CUBE-EDGE-ORIENTED SILICON STEEL, discloses a method in which specific decarburization annealing is effected on steel containing 0.0006 to 0.0080% of B and not more than 0.0100% of N, so as to achieve a high magnetic flux density of 1.89 T at $B_8$. This method, however, can offer only an insignificant increase in the magnetic flux density, thus failing to provide any remarkable reduction of core loss and, therefore, has not been put to industrial use. Nevertheless, this method is considered to be advantageous from an industrial point of view, because its method indicates a comparatively high level of stability of magnetic properties of the products.

OBJECTS OF THE INVENTION

Accordingly, an object of the present invention is to provide a method of producing a grain-oriented magnetic steel sheet with an inhibitor that enhances the degree of integrity of crystal grain orientation, thus achieving high magnetic flux density, while suppressing coarsening of the crystal grains and adversely affecting of core loss characteristics.

In general, a higher degree of integrity of crystal grain orientation essentially leads to coarsening of the crystal grains, resulting in inferior and unstable core loss characteristics of the products. Conversely, finer crystal grains tend to lower the degree of integrity of crystal orientation, resulting in reduction of magnetic flux density. Thus, the conditions for achieving very high magnetic flux density and the condition for achieving low core loss are incompatible. For this reason, it has been impossible to produce a steel material which simultaneously provides both very high magnetic flux density and low core loss. Under these circumstances, the present invention is aimed at providing a method of producing a grain-oriented magnetic steel sheet to achieve a very high level of magnetic flux density $B_8$ while enhancing stability of the quality which is attributable to coarsening of crystal grains and which inherently exists in this type of technique.

In order to overcome the difficulty which arises from the incompatible conditions stated above, the inventors have conducted intense study and research, and have discovered that the states of precipitation and dispersion of AlN or BN as the inhibitor are important. More specifically, the inventors have discovered that, by adopting novel precipitation conditions which are entirely different from those of conventional methods, it is possible to cause AlN or BN to precipitate extremely finely, thus strongly suppressing growth of primary crystal grains.

BRIEF DESCRIPTION OF THE INVENTION

According to the present invention, a method is provided for producing a grain-oriented magnetic steel exhibiting a very low core loss and high magnetic flux density, comprising the steps of:

preparing a silicon steel slab having a composition containing C: from about 0.025 to 0.095 wt %, Si: from about 1.5 to 7.0 wt %, Mn: from about 0.03 to 2.5 wt %, S and/or Se: from about 0.003 to 0.0400 wt %, a nitride type inhibitor component comprising Al: from about 0.010 to 0.030 wt % and/or B: from about 0.0008 to 0.0085 wt %, and N: from about 0.0030 to 0.0100 wt %;

heating the slab to a temperature not lower than about 1300° C.;

hot-rolling the slab followed by a cold rolling into a final cold-rolled sheet thickness, wherein the cold rolling is executed either by:

(a) being preceded by hot-rolled sheet annealing subsequent to the hot rolling, through a single-stage cold rolling or a two-stage cold rolling with intermediate annealing, or by:

(b) without being preceded by hot-rolled sheet annealing, through a two-stage cold rolling with intermediate annealing; and conducting primary recrystallizing annealing, application of an annealing separator and final finish annealing;

the method being characterized by a sequential combination of:

hot rolling with cumulative rolling reduction at the finish hot rolling within the range of from about 85 to 99% and such that the finish hot rolling finish temperature T ranges from about 950° to 1150° C. and meets the condition of the following equation (1), where X represents the Si content (wt %), Y represents the Al content (wt ppm) and Z represents the B content (wt ppm);

the steel sheet after hot rolling being rapidly cooled at a cooling rate not less than about 20° C./s and coiled at a temperature not higher than about 670° C.;

both the hot-rolled sheet annealing and the intermediate annealing (of cold-rolled sheet) being conducted under such conditions that the steel sheet is heated up to about 800° C. at an average heating rate of from about 5° to 25° C./s and held for a period not longer than about 150 seconds at a temperature ranging from about 800° to 1125° C.;

the cold rolling being executed either by:

(c) single-stage cold rolling down to final cold-rolled thickness by a single step of cold rolling at a rolling reduction of from about 80 to 95%, or by:

(d) two-staged cold rolling through a first step of cold rolling effected at a rolling reduction of from about 15 to 60% and a second step of cold rolling effected after intermediate annealing at a rolling reduction of from 80 to 95% into the final cold-rolled thickness; and final finish annealing being executed in an $H_2$-containing atmosphere at least after the steel sheet temperature has reached about 900° C. in the course of the heating up of the steel sheet.

The aforementioned equation (1) is:

$$610+35X+\max(Y, 3Z) \leqq T \leqq 900+40X+\max(Y, 3Z) \quad (1)$$

Preferably, the method stated above is carried out such that: the nitride-type inhibitor component comprises Al: from about 0.010 to 0.030 wt % and N: from about 0.003 to 0.010 wt %; the slab is heated to a temperature not lower than about 1350° C.; the finish hot rolling finish temperature T meets the condition expressed by the following equation (2); both the hot-rolled sheet annealing and the intermediate annealing are executed at temperatures ranging from about 900° to 1125° C.; and the anneal parting agent contains from about 1 to 20 wt % of Ti compound and from 0.01 to 3.0 wt % of Ca compound.

The aforementioned equation (2) is:

$$610+40X+Y \leqq T \leqq 750+40X+Y \quad (2)$$

The Ti compound may be one or more of an oxide, nitride or sulfide containing Ti, such as $TiO_2$, TiN, $MgTiO_3$, $FeTiO_2$, $SrTiO_3$, TiS, or mixtures thereof.

Alternatively, the method may be carried out such that: the nitride-type inhibitor component comprises B: from about 0.0008 to 0.0085 wt % and N: from about 0.003 to 0.010 wt %; the slab is heated to a temperature not lower than about 1350° C.; the finish hot rolling finish temperature T meets the condition expressed by the following equation (3); and both the hot-rolled sheet annealing and the intermediate annealing are executed at temperatures ranging from about 900° to 1125° C. Equation (3) is:

$$745+35X+3Z \leqq T \leqq 900+35X+3Z \quad (3)$$

In each of the methods stated above, the cooling in the annealing which immediately precedes the final cold rolling may be conducted by rapid cooling so as to increase the content of solid-dissolved C.

The term "rapid cooling" means treatment executed in the course of cooling by which the solid-solution of C formed as a result of hot annealing is changed into supersaturated C. This is accomplished by spraying or applying a gaseous and/or liquid coolant to the steel sheet so as to achieve a cooling rate greater than that of natural cooling. This treatment provides, besides an increase of the solid-dissolved C, precipitation of fine carbides in combination with holding at a low temperature, thus contributing to further improvement in magnetic properties.

When such a rapid cooling is employed, the final cold rolling may comprise warm rolling conducted at a temperature ranging from about 90° to 350° C. or an interpass aging of from about 10 to 60 minutes conducted at a temperature ranging from about 100° to 300° C.

Each of the methods stated above may be carried out such that annealing immediately preceding final cold rolling comprises decarburization by about 0.005 to 0.025 wt %.

The above and other objects, features and advantages of the present invention will become clear from the following description of the preferred embodiments when the same is read in conjunction with the accompanying drawings, which illustrate but are not intended to define or limit the scope of the invention.

DESCRIPTION OF THE PREFERRED EMBODIMENTS

Figure 1:
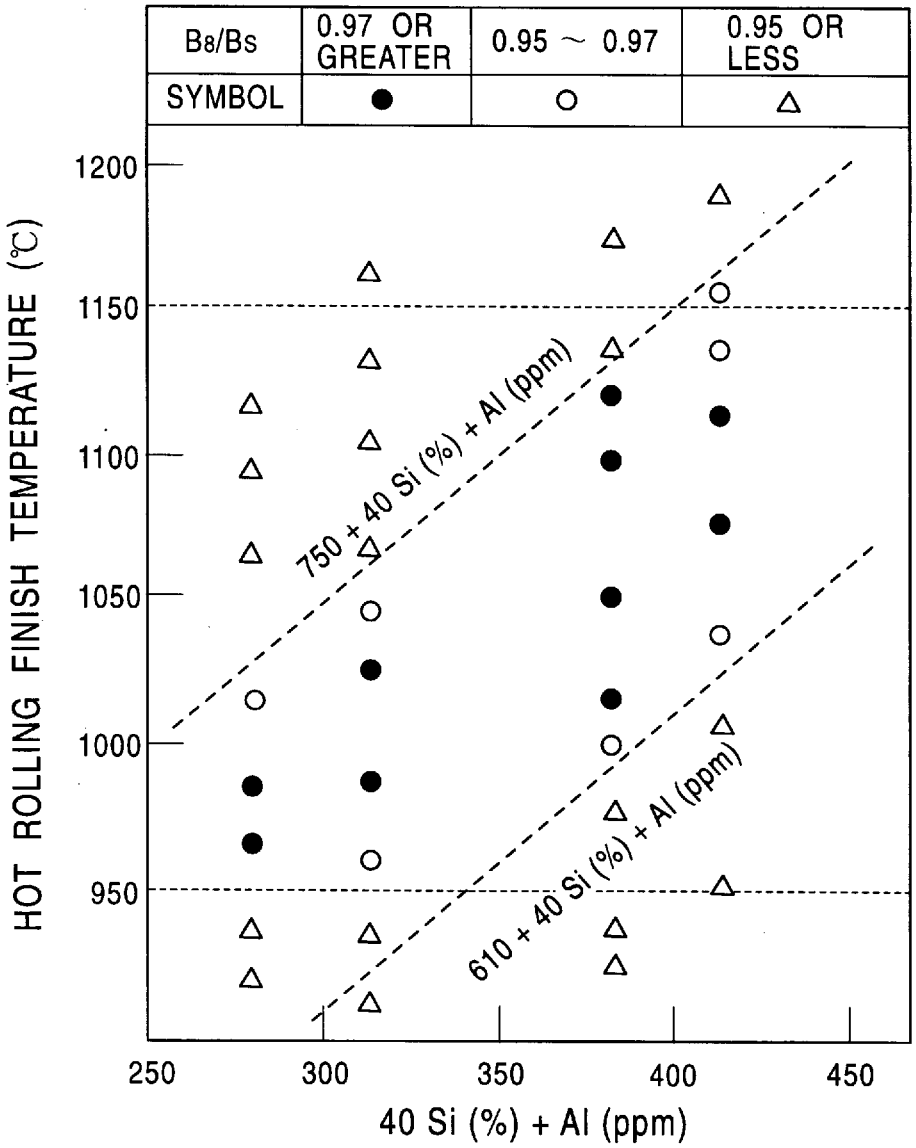
FIG. 1 is a graph showing the influence of Si content, Al content and hot-roll finish temperature on the magnetic flux density $B_8/B_s$ of steel materials.

In the following description, contents of elements are expressed in terms of percent by weight and shown simply by "%". The following report of Experiments is intended to be illustrative but not to limit the scope of the invention, which is defined in the appended claims.

EXPERIMENT 1

A pair of silicon steel slabs 250 mm thick were prepared, each having a composition containing C: 0.08%, Si: 3.32%, Mn: 0.07%, Al: 0.024%, Se: 0.020%, Sb: 0.040%, N: 0.008%, and the balance substantially Fe and incidental impurities. These slabs were heated to 1380° C.

One slab was subjected to a series of steps including rough rolling down to 45 mm thick at 1220° C., finish rolling down to 2.2 mm thick at 1050° C., cooling at a rate of 50° C./sec by spraying with a large quantity of water, and cooling at 550° C. This coil will be referred to as a coil PA.

The other slab was subjected to a series of steps including a rough rolling down to 45 mm thick at 1220° C., finish rolling down to 2.2 mm thick at 950° C., cooling at a cooling rate of 25° C./sec by spraying with a large quantity of water, and cooling at 550° C. This coil will be referred to as a coil PB.

Each of the coils was divided into two parts, to make hot-rolled steel sheet coils PA-1, PA-2, PB-1 and PB-2. The coils PA-1 and PB-1 were subjected to hot-rolled sheet annealing consisting in heating up to 1110° C. at a heating rate of 12° C./sec and holding at that temperature for 30 seconds, whereas the coils PA-2 and PB-2 were subjected to hot-rolled sheet annealing consisting in heating up to 1170° C. at a heating rate of 12° C./sec and holding at that temperature for 30 seconds.

These hot-rolled steel sheets were pickled and cold-rolled at 120° C. down to a final cold-rolled thickness of 0.27 mm, followed by degreasing, and were then coiled after application of an annealing separator to their surfaces. The annealing separator was composed of MgO containing 0.15% of Ca and 0.08% of B, with addition of 4.5% of $TiO_2$.

Each coil was then subjected to a final finish annealing heat cycle comprising the steps of heating up to 800° C. in an $N_2$ atmosphere at a heating rate of 30° C., heating from 800° C. to 1050° C. in an atmosphere consisting of 25% $N_2$ and 75% $H_2$ at a heating rate of 15° C./s, heating from 1050° C. to 1200° C. at a heating rate of 20° C./s and 5-hour soaking at 1200° C. in an $H_2$ atmosphere, forced cooling down to 800° C. in an $H_2$ atmosphere, and further cooling down from 800° C. in an $N_2$ atmosphere.

After final finish annealing, unreacted annealing separator was removed from each coil and a tension coat composed of 50% colloidal silica and magnesium phosphate was applied and baked to each coil. Coils were thus obtained as the products.

Epstein test pieces were obtained from these coils by cutting in the rolling direction, such that each test piece had a longer side which extends in the rolling direction. These test pieces were subjected to 3-hour stress removing annealing at 800° C. and then to measurements of core loss $W_{17/50}$ at a magnetic flux density of 1.7 T and a magnetic flux density value $B_8$. The test pieces were also macro-etched for measurement of average crystal grain sizes. The results of these measurements are shown in Table 1.

From Table 1 it is understood that the coil PA-1, which had undergone finish hot rolling at a high temperature and hot-rolled sheet anneal at a low temperature, exhibits much higher magnetic flux density $B_8$ and a much lower core loss $W_{17/50}$ than those exhibited by the coil PB-2 which had been rolled and treated under conventional conditions. This was a surprising phenomenon, the underlying reasons for which were not apparent.

EXPERIMENT 2

A pair of grain-oriented magnetic steel slabs 250 mm thick were prepared, each having a composition containing C: 0.08%, Si: 3.36%, Mn: 0.07%, Al: 0.009%, Se: 0.018%, Sb: 0.025%, B: 0.0020%, N: 0.008%, and the balance substantially Fe and incidental impurities. These slabs were heated to 1390° C.

One of the slabs was subjected to a series of steps including rough rolling down to 45 mm thick at 1200° C., finish rolling down to 2.2 mm thick at 1020° C., cooling at a cooling rate of 50° C./sec by spraying with a large quantity of water, and cooling at 550° C. This coil will be referred to as the coil RA.

The other slab was subjected to a series of steps including a rough rolling down to 45 mm thick at 1200° C., finish rolling down to 2.2 mm thick at 935° C., cooling at a cooling rate of 25° C./sec by spraying with a large quantity of water, and cooling at 550° C. This coil will be referred to as a coil RB.

Each of the coils was divided into two parts, whereby hot-rolled steel sheet coils RA-1, RA-2, RB-1 and RB-2 were produced. The coils RA-1 and RB-1 were subjected to hot-rolled sheet annealing consisting in heating up to 1100° C. at a heating rate of 12° C./sec and holding at that temperature for 30 seconds, whereas the coils RA-2 and RB-2 were subjected to hot-rolled sheet annealing consisting in heating up to 1170° C. at a heating rate of 12° C./sec and holding at that temperature for 30 seconds.

These hot-rolled steel sheets were pickled and cold-rolled down at 120° C. to the final cold-rolled thickness of 0.27 mm, followed by degreasing, and were then subjected to 2-minute annealing for decarburization and primary recrystallization at 850° C. The annealed steel sheets were then coiled after application of an annealing separator to their surfaces. The parting agent was composed mainly of MgO.

Each coil was then subjected to a final finish annealing heat cycle comprising the steps of heating up to 800° C. in an $N_2$ atmosphere at a heating rate of 30° C./h, heating from 800° C. to 1050° C. in an atmosphere consisting of 25% $N_2$ and 75% $H_2$ at a heating rate of 15° C./s, heating from 1050° C. to 1200° C. at a heating rate of 20° C./s and soaking 5 hours at this temperature in an $H_2$ atmosphere, and subsequent cooling. In this cooling phase, an $H_2$ atmosphere was used until the steel temperature came down to 800° C. and, for further cooling to lower temperature, an $N_2$ atmosphere was used.

After final finish annealing, unreacted annealing separator was removed from each coil and a tension coat composed of magnesium phosphate containing 50% colloidal silica was applied and baked to each coil, whereby a product was obtained.

Epstein test pieces were obtained from these product coils by cutting in the rolling direction, such that each test piece had a longer side which extended in the rolling direction. These test pieces were subjected to 3-hour stress removing annealing at 800° C. and then to measurements of core loss $W_{17/50}$ at a magnetic flux density of 1.7 T and a magnetic flux density value $B_8$. The test pieces were also macro-etched for measurement of average crystal grain sizes. The results of these measurements are shown in Table 2.

Table 2 shows that the coil RA-1, which had undergone finish hot rolling at high temperature and a hot-rolled sheet anneal at a low temperature, exhibited a much higher magnetic flux density $B_8$ and a much lower core loss $W_{17/50}$ than those exhibited by the coil RB-2 which had been rolled and treated under conventional conditions. The reasons underlying this phenomenon were not apprent.

However, we have discovered the following facts which hitherto had not been known.

A detailed discussion is initially necessary in regard to experiment 1, in which AlN served as inhibitor. The conventional methods are intended to cause a γ-transformation in the course of hot soaking during annealing of the hot-rolled sheet, aiming at dissolving AlN and subsequent re-precipitation of the same in the course of subsequent cooling. In contrast, we have found that the coil PA-1 which showed excellent properties in Experiment 1 owes its excellency to a strong inhibiting effect which is attributable to extremely fine AlN precipitated in the course of heating up of the slab during hot-rolled sheet annealing.

Deep consideration of Experiment 2, in which BN served as the inhibitor, is further necessary.

In Experiment 2, conventional methods could not realize fine and uniform precipitation of BN as the inhibitor, thus failing to make effective use of the inhibiting effect offered by BN. In contrast, in the course of production of the coil RA-1 which showed excellent properties, precipitation of BN in the course of hot rolling was suppressed as much as possible and, instead, precipitation of extremely fine BN was caused to occur in the course of heating during hot-rolled sheet annealing.

We have minutely investigated the process of fine precipitation of AlN or BN in the course of heating during the hot-rolled sheet annealing. As a result, we have discovered surprisingly that numerous micro-fine precipitates, which exist in the hot-rolled steel sheet, effectively serve as nuclei for the precipitation of AlN or BN. We have also found that these micro-fine precipitates include sulfides such as MnS, CuS and so forth, selenides such a MnSe, CuSe or the like and composite precipitates of sulfides and selenides. We have also been confirmed that extremely fine precipitation of these composites occur when finish hot rolling is executed at a temperature within a predetermined preferred temperature range. Thus, we have discovered that excellent properties are obtainable when precipitation of AlN or BN is suppressed as much as possible in the course of hot rolling, in which the rolled material still has a high density of defects produced by working, such as dislocation.

The upper limit of the temperature condition in the finish hot rolling has no dependency on the type of inhibitor.

In the case where the finish hot rolling is conducted at a temperature exceeding the upper limit of the preferred temperature range, the density of the defects existing in the steel is lowered, resulting in a lower density of micro-fine precipitates. Conversely, in the case where the finish hot rolling temperature is below the lower limit of the preferred temperature range, precipitation is undesirably suppressed. Thus, the density of precipitation of micro-fine precipitates is reduced in both cases. To obtain such micro-fine precipitates, it is necessary for the steel material to contain S and/or Se which are important precipitate elements. Since the precipitates are micro-fine, the content of these elements independently or in total may be as small as 0.003 wt % or more.

One of the important requisites in carrying out the method of the invention is to set the temperature of the hot-rolled sheet annealing temperature to a low level, in order to prevent dissolution or Ostwald ripening of the precipitated AlN or BN. The lower limit of the hot-rolled sheet annealing temperature in the present invention is intended to optimize the size of the crystalline structure to be obtained after annealing. When an excessively low annealing temperature is adopted, the (110) grains which would serve as nuclei for the secondary crystallization after rolling cannot provide sufficient strength, failing to provide secondary recrystallization structure having good orientation. In order to obtain strength of the (110) grains sufficient for providing good orientation, it is necessary that the crystalline structure after annealing is coarsened to a certain size or greater. To this end, it is essential that the temperature is raised to about 900° C. or higher during annealing.

As stated before, the upper limit of temperature of the hot-rolled sheet annealing has to be determined so as to meet, above all, the requirement for preventing dissolution and Ostwald ripening of the fine nitrides precipitated in the course of the temperature rise. To meet this requirement, it is necessary that the annealing temperature is not higher than about 1150° C. and that the time period of soaking in the annealing is about 150 seconds or shorter.

Reduction of precipitation of nitrides in the course of heating during annealing of the hot-rolled sheet is almost completed by the time the temperature reaches about 800° C. It is, however, necessary to control the heating rate, i.e., the rate at which the temperature rises, because the sizes and distributions of the precipitates vary according to the heating rate. More specifically, a heating rate below about 5° C./s tends to coarsen the precipitates, while a heating rate exceeding about 25° C. causes insufficiency in the amount of nitride precipitates.

Conditions of cooling subsequent to the annealing are not so critical. A quenching or rapid cooling, however, enhances solid-solution C in the steel, providing better primary recrystallization aggregate structure. A treatment which holds the annealed material at a low temperature, combined with quenching, further improves the primary recrystallization aggregate structure. Therefore, the rapid cooling treatment, with or without holding at a low temperature, may be employed in the method of the present invention. A still further improvement is obtained when a treatment for decarburizing the surface region is conducted during annealing.

As stated before, the method of the present invention features precipitation of fine nitrides in the course of heating during annealing of the hot-rolled sheet. A second requisite for enabling effective use of this technique is to minimize precipitation of nitrides during hot rolling which precedes annealing. Nitrides precipitated in the course of hot rolling serve as precipitation nuclei so that precipitation vigorously takes place in the course of heating up of the steel during hot-rolled sheet annealing, with the result that the inhibiting effect is deteriorated due to formation of few coarse nitride precipitates.

There are important requirements for preventing precipitation of nitrides in the course of the hot rolling. One is to control the hot rolling finish temperature to a high level to ensure that nitrides exist in the steel in the form of a super-saturated solution. It has been known that the temperatures at which nitrides precipitate vary according to the contents of Si, Al and B. It is therefore necessary that the hot rolling finish temperature varies in accordance with the contents of these elements. When hot rolling is finished at a low temperature, the nitrides undesirably precipitate during hot rolling. The coils PB-1 and RB-1 which were annealed at a low hot-rolled sheet anneal temperature in Experiments 1 and 2, not to mention the coils PB-2 and RB-2 in which hot-rolled sheet annealing was conducted at a high temperature to allow dissolving of precipitates and re-precipitation, showed unsatisfactory magnetic properties due to inferior secondary recrystallization which is attributable to reduction of the inhibiting effect caused by precipitation of few coarse nitrides.

Another requirement is to cool the steel sheet after hot rolling at a high cooling rate. Such rapid cooling presents the over-saturating Al and B from precipitating in the steel. Conversely, a too low cooling rate allows the AlN and BN to precipitate in the course of cooling. In order to prevent precipitation of nitrides in the course of cooling, the cooling rate should be about 20° C. or greater.

Still another requirement is that the sheet after hot rolling is coiled at a low coiling temperature. Since the coiled sheet is maintained for a long time at temperatures near the coiling temperature, a too high coiling temperature tends to allow precipitation of nitrides. It is essential that the coiling temperature is not higher than 670° C.

A study also was conducted to determine the optimum range of hot-rolling finish temperature in accordance with this invention.

EXPERIMENT 3

Grain-oriented magnetic steel slabs 250 mm thick, having compositions which were the same as those of Experiments 1 and 2 except for Al and B contents intentionally varied, were rolled and treated under the same conditions as the production of the coils PA-1 and RA-1 of Experiments 1 and 2, except that the hot rolling finish temperature was varied. The values of magnetic flux density $B_8/B_s$ were measured on these products, where Bs indicates the saturation magnetic flux density.

FIG. 1 of the drawings shows how the magnetic flux density $B_8/B_s$ is affected by factors such as the Si content, Al content and hot-rolling finish temperature.

From this Figure, it will be understood that, in order to achieve an extremely high value of 0.97 or greater as the value of the magnetic flux density $B_8/B_s$, the hot rolling finish temperature should be not lower than the higher of: a temperature expressed by (610+40X+Y), where X and Y are Si content (%) and Al content (ppm), and: 950° C., and should be not higher than the lower of: a temperature expressed by (750+40X+Y) and: 1150° C. When the hot rolling finish temperature is below the lower limit of the temperature range set forth above, AlN is precipitated in the course of hot rolling, whereas, when the hot rolling finish temperature exceeds the upper limit temperature, the size of the band structure of the hot-rolled sheet is increased due to the high hot rolling temperature, so the growth of good secondary recrystallization grains deteriorates.

Figure 2:
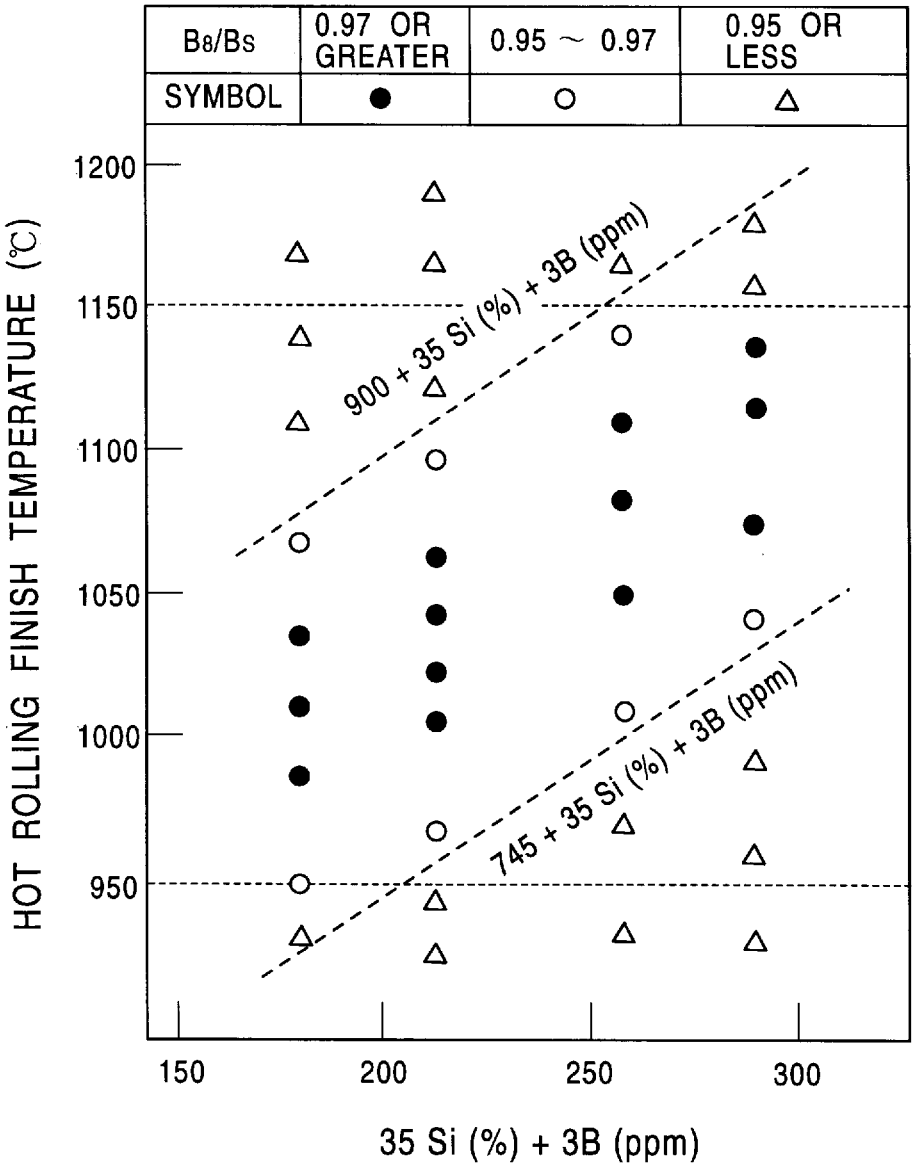
FIG. 2 is a graph showing the influence of Si content, B content and hot-roll finish temperature on the magnetic flux density $B_8/B_s$ of steel materials.

FIG. 2 of the drawings shows how the magnetic flux density $B_8/B_s$ is affected by factors such as Si content, B content and hot-rolling finish temperature.

From this Figure, it will be understood that, in order to achieve an extremely high value of 0.97 or greater for the magnetic flux density $B_8/B_s$, the hot rolling finish temperature should be not lower than the higher of: a temperature expressed by (745+35X+3Z), where X and Z are Si content (%) and B content (ppm), and: 950° C., and should not be higher than the lower one of: a temperature expressed by (900+35X +3Z) and: 1150° C. When the hot rolling finish temperature is below the lower limit of the temperature range set forth above, most of BN has been found to be precipitated in the course of hot rolling, whereas, when the hot rolling finish temperature exceeds the upper limit temperature, the size of the band structure of the hot-rolled sheet is increased due to the high hot rolling temperature, so the growth of good secondary recrystallization grains deteriorates.

Figure 3A:
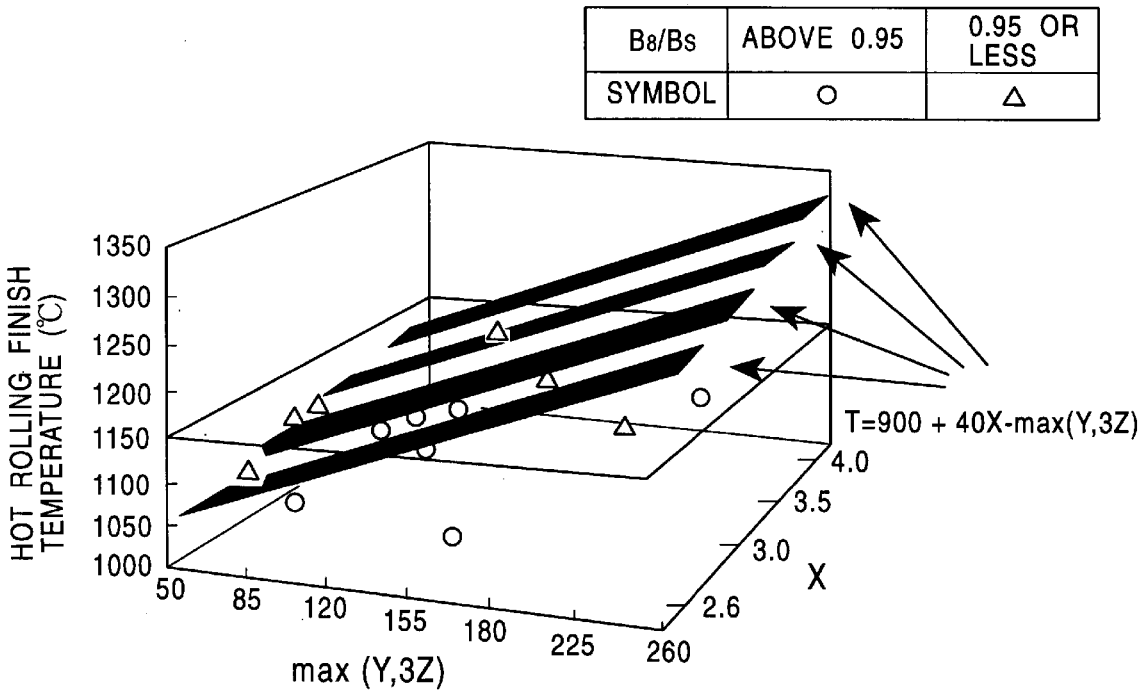
FIG. 3A is a graph showing the influence of Si content, Al content, B content and hot-roll finish temperature on the magnetic flux density $B_8/B_s$ of steel materials, as well as upper limit of hot roll finish temperature.
Figure 3B:
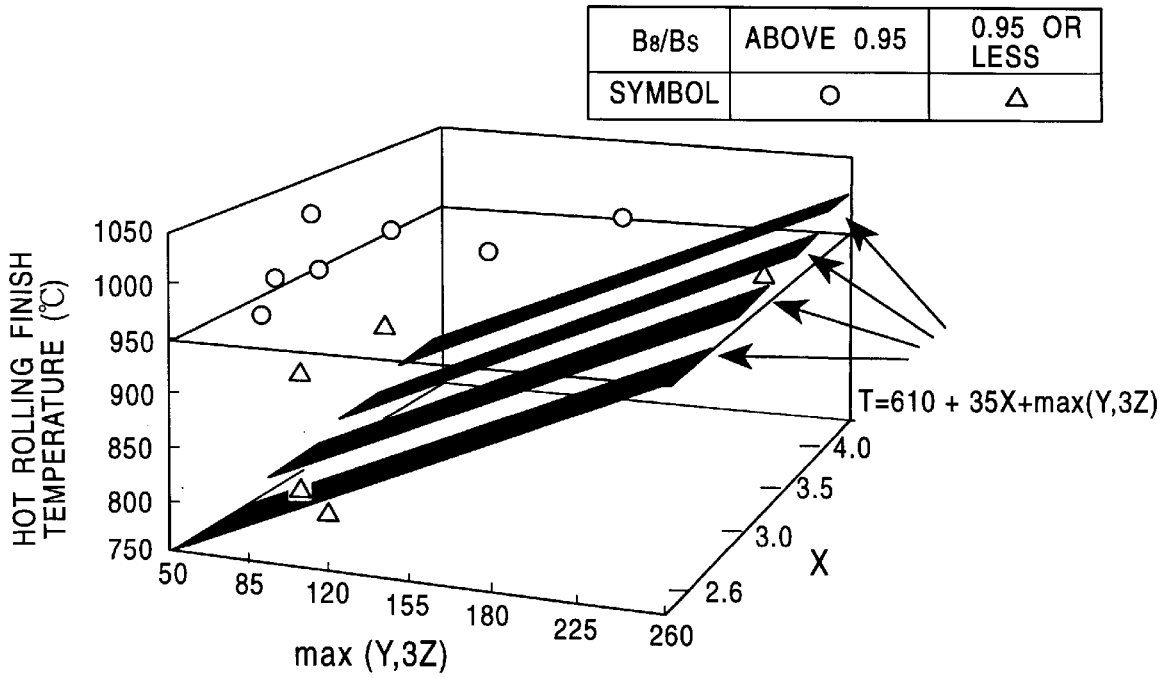
FIG. 3B is a graph showing the influence of Si content, Al content, B content and hot-roll finish temperature on the magnetic flux density $B_8/B_s$ of steel materials, as well as lower limit of hot roll finish temperature.

FIGS. 3A and 3B of the drawings are graphs showing how the magnetic flux density $B_8/B_s$ is affected by factors such as the Si content, Al content, B content and the hot rolling finish temperature. The compositions of the tested materials, hot rolling finish temperatures and the values of the magnetic flux density $B_8/B_s$ of the products are shown in Table 3. In Table 3, X indicates the Si content (%), Y indicates the Al content (ppm) and Z indicates the B content (ppm).

FIG. 3A shows that, in order to achieve an extremely high value of 0.95 or greater as the value of the magnetic flux density $B_8/B_s$, the hot rolling finish temperature should be not lower than the higher one of a temperature expressed by (610+35X +max(Y, 3Z)), where X, Y and Z are Si content (%), Al content (ppm) and B content (ppm), and 950° C. It will also be seen from FIG. 3B that, in order to achieve an extremely high value of 0.95 or greater as the value of the magnetic flux density $B_8/B_s$, the hot rolling finish temperature should be not higher than the lower one of a temperature expressed by (900+40X +max (Y, 3Z) and 1150° C.

Another requirement is that the hot-rolled sheet annealing temperature be set to a low level so as to obtain fine secondary recrystallized crystal grains. Although not all reasons have been theoretically established yet, it is believed that the smaller size of the secondary recrystallized grains, offered by the lower annealing temperature, is attributable to the fact that the lower annealing temperature suppresses the γ transformation so as to cause a substantial increase in crystal grain size before rolling, with the result that the frequency of generation of nuclei for the (110) grains is increased in the rolled primary recrystallization structure.

It is conventionally believed that an increase of the (110) grains in a primary recrystallization structure provides finer crystal grains in the secondary recrystallization structure. In conventional methods, this observation is inevitably accompanied by a reduction in magnetic flux density. In contrast, in the present invention, both the finer secondary recrystallization crystal grains and improved magnetic flux density are surprisingly simultaneously obtained, by virtue of the strong inhibiting effect produced by the inhibitor.

The cold rolling may be conducted in various forms. For instance, a single-stage cold rolling consisting of only one cycle of cold rolling, subsequent to hot-rolled sheet annealing, may be adopted. An alternative method is a two-stage cold rolling, which consists in a first cold rolling executed after hot-rolled sheet annealing and a second cold rolling executed subsequent to intermediate annealing, which is conducted subsequent to the first cold rolling. Another two-stage cold rolling procedure could omit the hot-rolled sheet annealing. Namely, annealing is executed for the first time intermediate a first cold rolling and a second cold rolling. In executing the first annealing executed in the cold rolling, i.e., hot-rolled sheet annealing (or intermediate annealing in the second-mentioned type of two-stage cold rolling), attention must be paid so as to promote precipitation of nitrides during temperature rise in annealing and to prevent Ostwald ripening and dissolution/re-precipitation of the precipitated nitrides. Attention must be paid also in intermediate annealing in the first-mentioned type of the two-stage cold rolling, so as to prevent Ostwald ripening and dissolving/re-precipitation of the precipitated nitrides.

The rolling reduction of the final cold rolling should be from 80 to 95%, as is well known in the art. Rolling reduction in final cold rolling below 80% permits the nuclei to grow to secondary recrystallized crystal grains having good orientation, causing a reduction in magnetic flux density. Conversely, when the rolling reduction exceeds 95%, the density of nuclei for the secondary recrystallized crystal grains is reduced and secondary recrystallization are caused insufficiently.

Another experiment was conducted regarding the optimum conditions for final finish annealing.

EXPERIMENT 4

Ten pieces of silicon steel slabs 250 mm thick were prepared, each having a composition containing C: 0.08%, Si: 3.38%, Mn: 0.07%, Al: 0.022%, Se: 0.020%, Sb: 0.035%, N: 0.008%, and the balance substantially Fe and incidental impurities. These slabs were heated to 1410° C., and were subjected to a series of steps including rough rolling down to 45 mm thick at 1250° C., finish rolling down to 2.2 mm thick at 1020° C., rapid cooling at a cooling rate of 55° C./sec by spraying a large quantity of water, and cooling at 550° C.

The hot-rolled sheets were heated at a heating rate of 6.5° C./sec, followed by 30-second hot-rolled sheet annealing conducted at 1050° C. The sheets were then pickled and warm-rolled by a Senszimir mill at temperatures between 120° and 160° C. down to a final thickness of 0.30 mm. Then, the sheets were subjected to degreasing followed by 2-minute annealing conducted at 850° C. for decarburization and primary recrystallization.

Subsequently, annealing separator shown in Table 4 were applied to the decarburized annealed sheets. The sheets were then subjected to final finish annealing which consists of a heat pattern having the steps of heating up to 1180° C. at a heating rate of 30° C./sec, holding the same for 7 hours at that temperature and subsequent cooling, wherein the heating up to 400° C. was conducted in an $N_2$ atmosphere and thereafter the compositions of the atmosphere were varied as shown in Table 3.

After final finish annealing, unreacted annealing separator was removed from each steel sheet and an insulation coat composed of 60% colloidal silica and magnesium phosphate was applied and baked at 800° C., whereby product sheets were obtained.

Epstein test pieces were obtained from these products by cutting in the rolling direction. These test pieces were subjected to 3-hour stress removing annealing at 800° C. and then to measurements of core loss $W_{17/50}$ at magnetic flux density of 1.7 T and magnetic flux density value $B_8$. Average crystal grain sizes also were measured. The results of these measurements are shown in Table 5.

Table 5 shows that the products PA and PB which were treated in the atmosphere composed of $N_2$ alone up to the high temperature in the final finish annealing show inferior magnetic characteristics. This is attributable to the fact that crystal grains formed by secondary recrystallization have inferior orientation due to progress of nitriding of the steel sheet, as demonstrated by the reduction in magnetic flux density and the measured values of the average crystal grain size.

It is also understood that Ca and Ti have to be present as essential elements in the annealing separator. During final finish rolling, MgO as the main component of the annealing separator reacts with $SiO_2$ formed on the steel surface in the course of decarburization annealing, so as to form a coating film which is composed mainly of forsterite ($Mg_2SiO_4$). Ca and Ti added to the annealing separator form nitrides or oxides of these elements in the coating film so as to strengthen the film to enhance the tensile effect of the film. It is considered that the improvement in magnetic properties owes to this effect.

The atmosphere of the final finish annealing plays an important role in the formation of oxides and nitrides in the film. It is considered to be necessary that the reducing ability of the atmosphere is enhanced specifically in the middle and later parts of the annealing period. More specifically, addition of $H_2$ serving as a strong reducer to the annealing atmosphere promotes decomposition of nitrides in the steel, so as to increase the Al content of the coating film. At the same time, the reducing atmosphere promotes the formation of the coating film, allowing the amounts of Ti and Ca in the coating film to be increased.

Through intense research and study for determining material compositions to develop the advantages of the present invention, we have found that the Al content preferably ranges from about 0.010 to 0.030%, in order to allow a sufficient precipitation of AlN in the course of heating of the steel during the hot-rolled sheet annealing.

EXPERIMENT 5

Ten pieces of silicon steel slabs 250 mm thick were prepared, each having a composition containing C: 0.08%, Si: 3.38%, Mn: 0.07%, Al: 0.008%, Se: 0.020%, Sb: 0.035%, B: 0.0025%, N: 0.008%, and the balance substantially Fe and incidental impurities. These slabs were heated to 1420° C., and were subjected to a series of steps including rough rolling down to 45 mm thick at 1270° C., finish rolling down to 2.2 mm thick at 1020° C., rapid cooling at a cooling rate of 65° C./sec by spraying a large quantity of water, and cooling at 550° C.

The hot-rolled sheets were heated at a heating rate of 9.5° C./sec, followed by 30-second hot-rolled sheet annealing conducted at 1080° C. The sheets were then pickled and warm-rolled by a Senszimir mill at temperatures between 120° and 160° C. down to a final rolled thickness of 0.30 mm. Then, the sheets were subjected to degreasing, followed by 2-minute annealing conducted at 850° C. for decarburization and primary recrystallization.

Subsequently, annealing separator shown in Table 5 were applied to the decarburized annealed sheets. The sheets were then subjected to final finish annealing which consists of a heat pattern having the steps of heating to 1180° C. at a heating rate of 30° C./sec, holding the same for 7 hours at that temperature and subsequent cooling, wherein the heating to 400° C. was conducted in an $N_2$ atmosphere and thereafter the compositions of the atmosphere were varied as shown in Table 6.

After final finish annealing, unreacted annealing separator was removed from each steel sheet and an insulation coat composed of 50% colloidal silica and magnesium phosphate was applied and fired at 800° C., whereby products were obtained.

Epstein test pieces were obtained from these products by cutting in the rolling direction such that the direction of the longer side of the test piece coincides with the direction of rolling. These test pieces were subjected to 3-hour stress removing annealing at 800° C. and then to measurements of core loss $W_{17/50}$ at magnetic flux density of 1.7 T and magnetic flux density value $B_8$. Average crystal grain sizes also were measured. The results of these measurements are shown in Table 7.

From Table 7, it is understood that the products RA and RB which were treated in the atmosphere composed of $N_2$ alone up to the high temperature in the final finish annealing show inferior magnetic characteristics. It will be seen also that Ca, B and Ti added to the annealing separator effectively contribute to further improvement in the magnetic properties. During final finish rolling, MgO as the main component of the annealing separator reacts with $SiO_2$ formed on the steel surface in the course of decarburization annealing, so as to form a coating film which is composed mainly of forsterite ($Mg_2SiO_4$). Ca, B and Ti added to the annealing separator form nitrides or oxides of these elements in the coating film so as to strengthen the film to enhance the tensile effect of the film. It is considered that the improvement in the magnetic properties owes to this effect.

The atmosphere of the final finish annealing plays an important role in the formation of oxides and nitrides in the film. It is considered that enhancement of the reducing ability of the atmosphere specifically in the middle and later parts of the annealing period further improves the magnetic properties.

It is clear from a technical point of view that the requirements for the atmosphere of the final finish annealing apply also to the case where both AlN and BN are simultaneously used as the inhibitors.

A detailed description will now be given of the preferred ranges of constituent elements of the grain-oriented magnetic steel to be used in the invention, as well as the ranges of conditions under which the production method of the present invention is carried out. C: about 0.025 to 0.095%

C content exceeding about 0.095% causes excessive γ transformation, tending to provide a non-uniform distribution of Al during the hot rolling, thus impeding uniform distribution of nitrides precipitated in the course of heating during the hot-rolled sheet annealing and intermediate annealing, i.e., AlN and BN. At the same time, decarburization become difficult, tending to cause inferior decarburization. Conversely, C content below about 0.025% does not provide appreciable effect of improving the structure: namely, secondary recrystallization is rendered imperfect, so the magnetic properties deteriorate. For these reasons, the C content preferably ranges from about 0.025 to 0.095%.

Si: about 1.5 to 7.0%

Si is an element which is essential for increasing the electrical resistance so as to reduce the core loss. To this end, the Si content should not be less than about 1.5%. Si content exceeding about 7.0% impairs the workability of the material, causing impediment to the production of the steel sheets and working of the product steel sheets. The Si content therefore should range from about 1.5 to 7.0%.

Mn: about 0.03 to 2.5%

Mn is an important element as it serves to increase electrical resistance similarly to Si, and improves hot workability of the material. To this end, it is necessary that the Mn content is not less than about 0.03%. On the other hand, Mn content exceeding about 2.5% induces γ transformation, so the magnetic properties deteriorate. The Mn content, therefore, should range from about 0.03 to 2.5%.

The steel has to contain an inhibitor for causing secondary recrystallization, besides the elements stated above. More specifically, the steel should contain N and at least one of Al and B as inhibitor components.

Al: about 0.010 to 0.030%

When Al content is below about 0.010%, it is impossible to obtain sufficient precipitation of AlN in the course of heating up of the material during the hot-rolled sheet annealing or the intermediate annealing, resulting in inferior secondary recrystallization. Conversely, when Al content exceeds about 0.030%, the precipitation temperature of AlN is raised to such a level that the precipitation of AlN cannot be suppressed by ordinary hot-rolling conditions. The Al content, therefore, should range from about 0.010 to 0.030%.

B: about 0.0008 to 0.0085%

When B content is about below 0.0008%, it is impossible to obtain sufficient precipitation of BN in the course of heating up of the material during the hot-rolled sheet annealing or the intermediate annealing, resulting in inferior secondary recrystallization. Conversely, when Al content exceeds about 0.085%, the precipitation temperature of BN is raised to such a level that the precipitation of BN cannot be suppressed by ordinary hot-rolling conditions. The B content, therefore, should range from about 0.0008 to 0.0085%.

N: about 0.0030 to 0.0100%

When N content is below about 0.0030%, it is impossible to obtain sufficient precipitation of nitrides in the course of heating up of the material during the hot-rolled sheet annealing or the intermediate annealing, resulting in inferior secondary recrystallization. Conversely, when Al content exceeds about 0.0100%, defects such as inflation are produced in the steel. The N content, therefore, should range from about 0.0030 to 0.0100%.

The steel material also is required to contain, in addition to the elements stated above, certain amounts of S and/or Se.

S or Se or S and Se in total: about 0.003 to 0.040%

S and/or Se precipitates in the steel in the form of Mn compounds or Cu compounds. Such compounds, however, do not produce any appreciable inhibiting effect. Rather, these compounds function as nuclei for precipitation of nitrides which occur in the course of heating up of the material during the hot-rolled sheet annealing. A small amount of S and/or Se suffices for the purpose of formation of ultra-fine nuclei dispersed at high density. Thus, about 0.003% or more is a sufficient content of S or Se alone, or S and Se in combination, for this purpose. A large content of S and/or Se does not cause any surplus S and/or Se to precipitate in the form of coarse precipitates. Such coarse precipitates do not produce any critical detrimental effect. However, if the content exceeds about 0.040%, precipitation occurs in grain boundaries, so the workability of the material under hot rolling deteriorated. For these reasons, the content of S or Se alone or S and Se in combination should range from about 0.003 to 0.040%.

It is also preferred that the steel contains one or more of Sb, Sn, Bi, Te, Ge, P, Pb, Zn, In and Cr, as these elements serve as assistant inhibitors which enhance the inhibiting effect. The content of each of such elements should be from about 0.0010 to 0.30%.

Other elements such as Ni, Co, Mo or the like may be added as required since they are effective to improve the properties of sheet surfaces.

A description will now be given of the production method in accordance with the present invention. The method of the invention uses a slab as a grain-oriented magnetic steel having a composition which falls within the range described hereinabove. Such a slab can be prepared by any known technique.

After an ordinary slab heating treatment, the slab is hot-rolled into a hot-rolled sheet which is then coiled. It is one of the critical features of the present invention that the slab is heated to a temperature not less than about 1300° C., preferably not less than about 1350° C. A slab heating temperature less than about 1300° C. does not provide sufficient solid-solution of the inhibitor, thus hampering creation of fine and uniform distribution of nitrides in the subsequent annealing. It is possible to conduct, before or after slab heating prior to hot rolling, known treatments such as thickness reducing treatment breadthwise rolling, in order to obtain a uniform material structure.

According to the present invention, it is necessary that the hot rolling is executed so as to meet the following requirements.

One requirement is that cumulative rolling reduction at the finish rolling ranges from about 85 to 99%. When the cumulative rolling reduction is below about 85%, the spacing of band structures is increased, resulting in insufficient secondary recrystallization, whereas a cumulative rolling reduction exceeding about 99% allows recrystallized crystal grains to exist in the hot-rolled sheet, resulting in a coarse dispersed precipitation of AlN or BN in the course of subsequent process.

Another requirement is that the finish rolling temperature T (°C.) is controlled in a range from about 950° C. to 1150° C. and that the condition expressed by the following equation (1) is approximately met, where X represents the Si content (%), Y represents the Al content (%) and Z represents the B content (ppm):

$$610+35X+\max(Y, 3Z) \leqq T \leqq 900+40X+\max(Y, 3Z) \quad (1)$$

A finish rolling temperature significantly below the lower limit of the range shown by equation (1) allows nitrides such as AlN or BN to precipitate in the course of hot rolling, which hampers fine and uniform precipitation of nitrides in hot-rolled sheet annealing or intermediate annealing, with the result that the density of defects in the steel is lowered to suppress high-density precipitation of micro-fine sulfides and selenides which are provided to serve as the nuclei for precipitation of nitrides. Consequently, a finish rolling temperature significantly below the lower limit of the range shown by the equation (1) hampers fine and uniform dispersion of nitrides, thus causing impediment to the improvement in the magnetic properties.

In particular, when AlN alone is used as the inhibitor nitride, it is preferred that the finish rolling temperature T (°C.) is set to range from about 950° C. to 1150° C. and that the condition expressed by the following equation (2) is approximately met:

$$610+40X+Y \leqq T \leqq 750+40X+Y \quad (2)$$

When BN alone is used as the inhibitor nitride, it is preferred that the finish rolling temperature T (°C.) is controlled to a range from about 950° C. to 1150° C. and that the condition expressed by the following equation (3) is approximately met:

$$745+35X+3Z \leqq T \leqq 900+35X+3Z \quad (3)$$

Still another requirement is that the hot-rolled sheet is rapidly cooled at a cooling rate which is not lower than about 20° C./s. Such a rapid cooling suppresses precipitation of nitrides, thus enhancing precipitation of nitrides in the course of heating of the steel sheet in the hot-rolled sheet annealing or intermediate annealing.

Yet another requirement is that the coiling temperature is set to be not higher than about 670° C. Coiling temperature exceeding this temperature allows coarse precipitation of nitrides so that the inhibiting effect of the inhibitor is suppressed, failing to provide the desired magnetic properties.

The cold rolling may be a single-stage cold rolling consisting of only one cycle of cold rolling subsequent to hot-rolled sheet annealing, or may be a two-staged cold rolling which consists in a first cold rolling executed after hot-rolled sheet annealing and a second cold rolling executed subsequent to intermediate annealing which is conducted subsequent to the first cold rolling. Another two-staged cold rolling may be used which omits the hot-rolled sheet annealing in which annealing is conducted for the first time intermediate between a first cold rolling and a second cold rolling. The fine precipitation of nitrides, which is the basic feature of the present invention, is effected in the course of heating of the material in the first annealing executed during cold rolling, i.e., hot-rolled sheet annealing (or intermediate annealing in the second-mentioned type of two-staged cold rolling). In the subsequent portion of the first annealing (or intermediate annealing when the first-mentioned type of two-staged cold rolling is adopted), it is very important to prevent Ostwald ripening and dissolution/re-precipitation of the precipitated nitrides.

In order to ensure fine precipitation of nitrides in the course of heating of the material in the first annealing executed during cold rolling, i.e., hot-rolled sheet annealing in single-stage cold rolling and in the first-mentioned type of two-staged cold rolling (or intermediate annealing in the second-mentioned type of two-staged cold rolling), it is necessary that the rate of temperature rise in the heating phase is from about 5° to 25° C./c. When the heating rate is below about 5° C./s, precipitation is rendered coarse, failing to provide the desired strong inhibiting effect. Inhibiting effect is impaired also when the heating rate exceeds about 25° C./s, due to insufficiency of precipitation.

The annealing should include holding the material for a period of about 150 seconds or shorter, at a temperature ranging from about 800° to 1125° C., preferably from about 900° to 1125° C. A too low annealing temperature causes insufficiency in the number of the (110) grains which would serve as nuclei for the secondary recrystallization in the structure obtained after rolling, thus failing to provide a secondary recrystallization structure of good orientation. Therefore, in order to obtain sufficient number of the (110) grains, it is necessary that the annealing is conducted in such a manner as to coarsen the crystalline structure after annealing to a certain size or greater. To this end, it is necessary that the annealing is conducted at a temperature of about 800° C., or higher, preferably at about 900° C. or higher. Regarding the upper limit of the annealing temperature, one of the most important concerns is to prevent Ostwald ripening or dissolution of the nitrides which have been precipitated. To this end, the annealing temperature should not exceed about 1125° C., and the shelving time over which the material is held at the annealing temperature should not exceed about 150 seconds.

No specific requirement is imposed on the cooling phase of the annealing step. It is to be noted, however, that rapid cooling for the purpose of increasing solid solution C in the annealed steel, as well as rapid cooling and subsequent shelving at a low temperature for the purpose of precipitation of fine carbide grains, is effective because it contributes to improvement in the magnetic properties of the products.

The term "rapid cooling" is used in this specification to mean treatment in which a gaseous and/or liquid coolant is applied to the steel sheet so as to provide a greater cooling rate than natural cooling. This may be conducted by, for example, jetting $N_2$ gas or spraying water mist or water jet on the steel sheet to accelerate cooling of the steel sheet.

A conventional technique for decarburizing the surface region of the steel sheet by enhancing the oxidizing effect of the annealing atmosphere can also be used effectively in the present invention. Preferably, the rate of decarburization effected in hot-rolled sheet annealing prior to the final cold rolling or in the intermediate annealing ranges from about 0.005 to 0.025%.

Such decarburization reduces the C content of the surface region of the steel sheet, with the result that the amount of $\gamma$ transformation at the time of annealing is reduced. Consequently, the inhibiting effect of the inhibitor is enhanced in the surface region of the sheet in which nuclei for the secondary recrystallization grain are formed, whereby more preferred secondary recrystallization grains are obtained. In order to achieve this effect, it is preferred that the C content of the steel sheet is reduced by an amount of 0.005% or more. Reduction of the C content by an amount exceeding 0.025%, however, is not preferred because such a reduction serves to degrade the primary recrystallization structure.

The second annealing of the second-mentioned type of two-staged cold rolling, i.e., the intermediate annealing, also should be conducted at a temperature ranging from 900° to 1150° C. and for a period which is not longer than 150 seconds, as in the case of the first annealing, in order to maintain the finely precipitated nitrides and to adjust the crystalline structure.

As to the rolling reduction to be achieved in cold rolling, it is necessary that the rolling reduction in the final cold rolling ranges from about 80 to 95%, as is known in the art. Rolling reduction exceeding about 95% impedes the secondary recrystallization, while a rolling reduction below about 80% fails to provide good orientation of the secondary recrystallization crystal grains. Consequently, magnetic flux density of the product is degraded when the rolling reduction of the final cold rolling does not fall within the range shown above.

When either one of the aforesaid two-staged cold rolling technique is employed, the first cold rolling should be effected such that the rolling reduction ranges from about 15 to 60%. When the rolling reduction is below about 15%, the rolling recrystallization mechanism does not work well, failing to provide desired uniformity of the crystalline structure. Conversely, when the rolling reduction exceeds about 60%, integration of the crystalline structure takes place, so that the second cold rolling does not produce any appreciable effect.

The final cold rolling may effectively employ, as well known in the art, a warm rolling conducted at a temperature of from about 90° to 350° C., as well as an inter-pass aging conducted for about 10 to 60 minutes at a temperature of about 100° to 300° C., because such a treatment improves the primary recrystallization structure so as to provide advantageous effects.

It is also possible to form linear flutes in the surfaces of the steel sheets after the final cold rolling, in order to attain finer magnetic domains, as known in the art.

The steel sheet thus finally cold-rolled is subjected to a primary recrystallization annealing which is conducted in a manner known per se and, after application of an annealing separator composed mainly of MgO to the surfaces thereof, subjected to the final finish annealing. Preferably, the annealing separator contains Ti compounds, as well as Ca and/or B, because such elements serve to further improve the magnetic properties.

In particular, when AlN alone is used as the inhibitor, it is preferred that the annealing separator contains about 1 to 20% of Ti compounds and about 0.01 to 3.0% of Ca, and that the final finish annealing is executed by using an annealing atmosphere containing $H_2$, at least after the steel sheet temperature has been raised to about 900° C. in the course of heating.

Thus, the atmosphere used in the final finish annealing should contain $H_2$ after the steel temperature has reached about 900° C. at the lowest, in the course of the heating up of the steel sheet. In other words, if the $N_2$ atmosphere is maintained till the steel temperature reaches the final annealing temperature, nitriding of the steel sheet proceeds during the final finish annealing, with the result that crystal grains of inferior orientation are formed by the secondary recrystallization, resulting in degradation of the magnetic flux density. It is therefore necessary that $H_2$ is supplied into the final finish annealing atmosphere, at least in the period after the steel sheet temperature has reached about 900° C. in the course of heating up of the steel sheet. The $H_2$-containing atmosphere plays an important role in the formation of oxides and nitrides of Ti, Ca and B in the coating film. Such oxides and nitrides contribute to enhancement of the tension of the coating film. To this end, it is important that the reducing ability of the annealing atmosphere is increased in the middle to the last part of the annealing period in which the steel sheet temperature is about 900° C. or higher.

An insulating coating is formed on the surfaces of the finally-finish-annealed steel sheet, preceded by removal of unreacted annealing separator. The steel sheet surface may be mirror-finished prior to formation of the insulating coat. It is also possible to form a tension coating together with the insulating coating. The baking step for fixing the coating may be conducted such that the baking also smooths the surfaces of the product sheets.

In order to achieve a further reduction of core loss, the steel sheet after secondary recrystallization may be subjected to a known treatment for realizing finer division of magnetic domains, such as by linear application of plasma jet or laser irradiation, or by mechanical treatment such as formation of linear indentations by a knurling roll, for example.

The following Examples are intended to be illustrative, and not to define or limit the scope of the claims.

EXAMPLE 1

Silicon steel slabs were prepared, each having a composition containing C: 0.08%, Si: 3.35%, Mn: 0.07%, Al: 0.022%, Se: 0.012%, Sb: 0.02%, N: 0.008%, and the balance substantially Fe and incidental impurities. These slabs were heated to 1410° C. Each slab was subjected to a series of steps including a rough rolling into a sheet bar of 45 mm thick at 1230° C., finish rolling down to 2.2 mm thick at 1020° C., cooling at a cooling rate of 25° C./s by spraying cooling water, and coiling at 600° C.

The hot-rolled steel sheet was subjected to hot-rolled sheet annealing consisting of heating up to 1100° C. at a heating rate of 12.5° C./s and holding at this temperature for 30 seconds. Then, after pickling, the sheet was cold-rolled into a sheet of 1.5 mm thick.

The coiled cold-rolled sheet was divided into two parts, and each part was subjected to intermediate annealing in an $H_2$ atmosphere having a dew point of 40° C., so as to decrease the C content to 0.06%. More specifically, one of these two parts of the coiled sheet was annealed under annealing conditions of 1080° C. and 50 seconds which meet the requirements of the invention, while the other, intended to provide a comparative example, was annealed at conditions of 1200° C. and 50 seconds, failing to meet the requirements of the invention.

Each steel sheet which had undergone intermediate annealing was subjected to a warm rolling conducted at 220° C. into a final cold-rolled thickness of 0.22 mm, followed by degreasing and subsequent decarburization/primary recrystallization annealing conducted at 850° C. for 2 minutes. Then, an annealing separator composed of MgO containing 0.5% of Ca, with addition of 5% $TiO_2$, was applied to the steel sheet. The steel sheet was then subjected to final finish annealing comprising heating up to 800° C. in an $N_2$ atmosphere at a heating rate of 30° C./h, heating from 800° C. to 1050° C. in an atmosphere consisting of 25% $N_2$ and 75% $H_2$ at a heating rate of 12.5° C./h, heating from 1050° C. to 1200° C. at a heating rate of 25° C./h and 6-hour holding at this temperature in $H_2$ atmosphere, and subsequent cooling in which an $H_2$ atmosphere was used until the temperature came down to 600° C. and an $N_2$ atmosphere was used for further cooling down from 600° C.

After final finish annealing, unreacted annealing separator was removed from each coil and a tension coat composed of magnesium phosphate containing 60% colloidal silica was applied and baked to each coil at 800° C. Then, treatment for obtaining finer magnetic domains was conducted by applying a plasma jet at a pitch of 6 mm, whereby the product sheet was obtained for each part of the steel sheets.

These product sheets were subjected to measurement of magnetic properties. The results are:

| | Magnetic flux density $B_8$ (T) | Core loss $W_{17/50}$ (W/Kg) |
|---|---|---|
| Invention | 1.982 | 0.652 |
| Comparative Example | 1.905 | 0.965 |

The steel sheet produced under the invention exhibited extremely superior magnetic properties as compared with the comparative example, in which the temperature of intermediate annealing exceeded the upper limit in accordance with the invention.

EXAMPLE 2

Silicon steel slabs having various compositions as shown in Table 8 were heated to 1430° C. and were coarse-rolled to sheet bars 50 mm thick at 1250° C., followed by finish rolling. More specifically, the steel sheet VII and X were finish-rolled at a finish rolling finish temperature of 1000° C., while other steel sheets were finish-rolled at a finish temperature of 1030° C., into sheets 2.6 mm thick. Then, a water jet was applied so as to cool the sheet at a rate of 35° C./s, and the sheet was coiled at 550° C., whereby a coiled hot-rolled sheet was obtained.

Each of the hot-rolled steel sheets was pickled and cold-rolled into a sheet of 1.8 mm thick, and was subjected to intermediate annealing which consisted of heating to 1080° C. at a heating rate of 15° C./s and holding the sheet for 50 seconds in an $H_2$ atmosphere having a dew point of 50° C. Then, warm rolling was conducted at a sheet temperature of 230° C., whereby a finally-cold-rolled sheet of 0.26 mm thick was obtained.

The cold-rolled steel sheet was subjected to degreasing and subsequent decarburization/primary recrystallization annealing conducted at 850° C. for 2 minutes. Then, an annealing separator composed of MgO containing 0.35% of Ca and 0.07% of B, with addition of 5% $TiO_2$ and 2% of $Sr(OH)_2$ was applied to the steel sheet, which was then coiled. The steel sheet was then subjected to final finish annealing having the steps of heating up to 850° C. in an $N_2$ atmosphere at a heating rate of 30° C./h, holding at 850° C. for 25 hours, heating from 850° C. to 1200° C. in an atmosphere consisting of 25% $N_2$ and 75% $H_2$ at a heating rate of 15° C./h and holding the sheet at this temperature in an $H_2$ atmosphere for 5 hours, and subsequent cooling.

Then, after removal of unreacted annealing separator, a tension coating containing 50% colloidal silica was applied and baked to the sheet, whereby the product sheet was obtained.

Magnetic properties of the thus-obtained product sheets were measured to obtain the results as shown in Table 9.

Table 9, shows that the steel sheet products which fell within the scope of the invention exhibited superior magnetic properties as compared with the comparative examples wherein the content of Al, S+Se or N fell outside of the present invention.

EXAMPLE 3

A pair of sample silicon steel slabs were prepared, with each of the following four types of steel compositions Pa to Pd:

Silicon steel slab Pa C: 0.075%, Si: 3.35%, Mn: 0.07%, Al: 0.022%, S: 0.004%, Sb: 0.02%, N: 0.0075%, and the balance substantially Fe and incidental impurities;

Silicon steel slab Pb C: 0.073%, Si: 3.36%, Mn: 0.07%, Al: 0.024%, S: 0.002%, Sb: 0.02%, N: 0.0082%, and the balance substantially Fe and incidental impurities;

Silicon steel slab Pc C: 0.080%, Si: 3.52%, Mn: 0.07%, Al: 0.030%, S: 0.008%, Sb: 0.02%, N: 0.0075%, and the balance substantially Fe and incidental impurities; and Silicon steel slab Pd C: 0.073%, Si: 3.05%, Mn: 0.07%, Al: 0.018%, S: 0.004%, Sb: 0.02%, N: 0.0075%, and the balance substantially Fe and incidental impurities.

These steel slabs were heated to 1380° C. and were rough-rolled into sheet bars 35 mm thick, followed by finish rolling into sheets 2.2 mm thick, wherein one group of sheet bars was finish-rolled at a finish temperature of 985° C., while the other group was finish-rolled at a finish temperature of 1090° C. The steel sheets were then rapidly cooled by a water jet at a cooling rate of 45° C./s and were coiled at 570° C., whereby hot-rolled steel sheets were obtained.

The hot-rolled steel sheets were then subjected to hot-rolled sheet annealing consisting of heating up to 1100° C. at a heating rate of 15° C./s and holding at that temperature for 30 seconds, followed by pickling and subsequent cold rolling down to an intermediate sheet thickness of 1.5 mm. Then, intermediate annealing was conducted.

In this intermediate annealing, the steel sheets were held for 60 seconds at 1090° C., rapid-cooled by a spray of water mist at a cooling rate of 40° C./s, and were held for 30 seconds at 350° C. to allow precipitation of carbides.

Then, the steel sheets were rolled by a Senszimir mill at temperatures between 120° and 230° C. while being subjected to inter-pass aging of 15 to 35 minutes, into a final cold-rolled thickness of 0.22 mm.

Each cold-rolled steel sheet thus obtained was subjected to degreasing, followed by treatment for attaining finer magnetic domains in which grooves 50 μm wide and 20 μm deep, extending at an angle of 15° to the breadth of the steel sheet, were formed at a pitch of 4 mm as measured in the longitudinal direction of the steel sheet. The steel sheet was then subjected to decarburization/primary recrystallization annealing conducted at 850° C. for 2 minutes. Then, an annealing separator composed of MgO containing 0.22% of Ca and 0.08% of B, with addition of 7.5% $TiO_2$ and 3% of $SnO_2$ was applied to the steel sheet, which was then coiled. The steel sheet was then subjected to final finish annealing including heating up to 850° C. in an $N_2$ atmosphere at a heating rate of 30° C./h, holding at 850° C. for 25 hours, heating from 850° C. to 1150° C. in an atmosphere consisting of 25% $N_2$ and 75% $H_2$ at a heating rate of 15° C./h and holding the sheet at this temperature in an $H_2$ atmosphere for 5 hours, and subsequent cooling.

Then, after removal of unreacted annealing separator, a tension coating containing 50% colloidal silica was applied and baked to the sheet, whereby the product sheet was obtained.

Magnetic properties of the thus-obtained product sheets were measured and the results are shown in Table 10. Extremely low levels of core loss are exhibited by the steel sheets of the present invention which were produced from steel materials having S contents exceeding 0.003% at the finish hot-rolling finish temperature T which met the condition of $610+40X+Y \leqq T \leqq 750+40X+Y$ as heretofore described in this specification.

EXAMPLE 4

Ten slabs having the composition PVII shown in Table 8 were prepared and heated to 1400° C. Each slab was subjected to a series of steps including rough rolling into a sheet bar of 50 mm thick, finish rolling down to 2.7 mm thick at a rolling finish temperature of 1060° C., cooling at a cooling rate of 40° C./s by spraying cooling water, and coiling at 600° C.

The hot-rolled steel sheet was subjected to hot-rolled sheet annealing consisting of heating up to 1100° C. at a heating rate of 17° C./s and holding at this temperature for 60 seconds. Then, after pickling, the sheet was cold-rolled into a final cold-rolled thickness of 0.30 mm. Subsequently, degreasing was executed followed by a subsequent decarburization/primary recrystallization annealing conducted at 850° C. for 2 minutes.

Then, after application of annealing separator of compositions shown in Table 8, the steel sheets were subjected to final finish annealing in which an $N_2$ atmosphere was employed while the steel sheets were heated up to 400° C. Thereafter, atmospheres as shown in Table 8 were employed except that the final holding temperature was set to 1200° C. The heat pattern of this annealing was such that the steel sheets were heated up to 1200° C. at a heating rate of 25° C./s and held at this temperature for 8 hours, followed by cooling.

After final finish annealing, unreacted annealing separator was removed from each coil and aluminum phosphate containing 60% colloidal silica was applied and baked to each coil at 800° C. Then, a treatment for obtaining finer magnetic domains was performed by applying a plasma jet at a pitch of 7 mm, whereby the product sheets were obtained.

Magnetic properties of the thus-obtained steel sheets were measured and obtained the results shown in Table 11.

As will be seen from Table 11, all the steel sheets which meet the requirements of the present invention exhibited extremely low levels of core loss.

EXAMPLE 5

Silicon steel slabs were prepared, each having a composition containing C: 0.08%, Si: 3.32%, Mn: 0.07%, Al: 0.008%, S: 0.003%, Sb: 0.02%, Se: 0.015%, B: 0.0035%, N: 0.008%, and the balance substantially Fe and incidental impurities. These slabs were heated to 1420° C. Each slab was subjected to a series of steps including rough rolling into a sheet bar 45 mm thick at a rolling finish temperature of 1230° C., finish rolling down to 2.2 mm thick at a rolling finish temperature of 1020° C., cooling at a cooling rate of 25° C./s by spraying cooling water, and coiling at 600° C.

The hot-rolled steel sheet was subjected to hot-rolled sheet annealing consisting in heating up to 1100° C. at a heating rate of 15.5° C./s and holding at this temperature for 30 seconds. Then, after pickling, the sheet was cold-rolled into a sheet 1.5 mm thick.

The coiled cold-rolled sheet was divided into two parts, and each part was subjected to intermediate annealing in an $H_2$ atmosphere having a dew point of 40° C., so as to decrease the C content to 0.06%. More specifically, one of these two parts of the coiled sheet was annealed under annealing conditions of 1080° C. and 50 seconds which met the requirements of the invention, while the other (intended to provide a comparative example) was annealed at conditions of 1200° C. and 50 seconds, failing to meet the requirements of the invention. Each steel sheet which had undergone intermediate annealing was subjected to warm rolling conducted at 220° C. into a final cold-rolled thickness of 0.22 mm.

Then, degreasing was conducted followed by decarburization/primary recrystallization annealing conducted at 850° C. for 2 minutes. Then, an annealing separator composed of MgO containing 0.5% of Ca and 0.09% of B, with addition of 5% $TiO_2$, was applied to the steel sheet. The steel sheet was then subjected to final finish annealing having the steps of heating up to 800° C. in an $N_2$ atmosphere at a heating rate of 30° C./h, heating from 800° C. to 1050° C. in an atmosphere consisting of 25% $N_2$ and 75% $H_2$ at a heating rate of 12.5° C./h, heating from 1050° C. to 1200° C. at a heating rate of 25° C./h and 6-hour holding at this temperature in $H_2$ atmosphere, and subsequent cooling in which an $H_2$ atmosphere was used until the temperature came down to 600° C., and an $N_2$ atmosphere was employed for further cooling down from 600° C.

After final finish annealing, unreacted annealing separator was removed from each coil and a tension coat composed of magnesium phosphate containing 50% colloidal silica was applied and baked to each coil at 800° C. Then, a treatment for obtaining finer magnetic domains was conducted by applying a plasma jet at a pitch of 6 mm, whereby the product sheet was obtained for each part of the steel sheets.

These product sheets were subjected to measurement of magnetic properties to obtain the results as shown below.

| | Magnetic flux density $B_8$ (T) | Core loss $W_{17/50}$ (W/Kg) |
|---|---|---|
| Invention | 1.964 | 0.678 |
| Comparative Example | 1.902 | 0.938 |

As will be understood from the results of the measurement, the steel sheet produced under the conditions which met the requirements of the invention exhibited extremely superior magnetic properties as compared with the comparative example, in which the temperature of the intermediate annealing exceeded the upper limit of the range specified by the invention.

EXAMPLE 6

Silicon steel slabs having various compositions as shown in Table 12 were heated to 1430° C. and were rough-rolled to sheet bars 50 mm thick at 1250° C., followed by finish rolling. More specifically, the steel sheet bars RI to RVII and RX were finish-rolled at a finish temperature of 1000° C., steel sheet bars RVIII, RXI, RXII and RXIV were finish-rolled at a finish temperature of 1010° C., while other steels were finish-rolled at a finish temperature of 1010° C., into sheets 2.6 mm thick. Then, a water jet was applied so as to cool the sheet at cooling rates of 35° to 55° C./s, and the sheet was coiled at 550° C., whereby a coiled hot-rolled sheet was obtained.

Each of the hot-rolled steel sheets was pickled and cold-rolled into a sheet 1.8 mm thick, and was subjected to intermediate annealing which consisted of heating up to 1080° C. at a heating rate of 15° C./s and holding the sheet for 50 seconds in an $H_2$ atmosphere having a dew point of 50° C. Then, warm rolling was conducted at a sheet temperature of 230° C., whereby a finally-cold-rolled sheet of 0.26 mm thick was obtained.

The cold-rolled steel sheet was subjected to degreasing and a subsequent decarburization/primary recrystallization annealing conducted at 850° C. for 2 minutes. Then, an annealing separator composed of MgO, with addition of 8% $TiO_2$ and 2% of $Sr(OH)_2$ was applied to the steel sheet which was then coiled. The steel sheet was then subjected to final finish annealing comprising heating to 850° C. in an $N_2$ atmosphere at a heating rate of 30° C./h, holding at 850° C. for 25 hours, heating from 850° C. to 1200° C. in an atmosphere consisting of 25% $N_2$ and 75% $H_2$ at a heating rate of 15° C./h, and holding the sheet at this temperature in an $H_2$ atmosphere for 5 hours, and subsequent cooling.

Then, after removal of unreacted annealing separator, a tension coating containing 50% colloidal silica was applied and baked to the sheet, whereby the product sheet was obtained.

Magnetic properties of the thus-obtained product sheets were measured. The results are shown in Table 13.

From Table 13, it is understood that the steel sheet products which fall within the scope of the invention exhibited superior magnetic properties as compared with the comparative examples, the conditions of which did not meet the requirements of the present invention.

EXAMPLE 7

A pair of sample silicon steel slabs was prepared, with each of the following four types of steel compositions Ra to Rd:

Silicon steel slab Ra C: 0.075%, Si: 3.05%, Mn: 0.07%, Al: 0.012%, S: 0.015%, Sb: 0.02%, B: 0.0010%, N: 0.0075%, and the balance substantially Fe and incidental impurities;

Silicon steel slab Rb C: 0.078%, Si: 3.37%,. Mn: 0.07%, Al: 0.010%, S: 0.018%, Sb: 0.02%, B: 0.0038%, N: 0.0077%, and the balance substantially Fe and incidental impurities;

Silicon steel slab Rc C: 0.068%, Si: 3.49%, Mn: 0.07%, Al: 0.011%, S: 0.0016%, Sb: 0.02%, B: 0.0043%, N: 0.0075%, and the balance substantially Fe and incidental impurities; and Silicon steel slab Rd C: 0.074%, Si: 3.23%, Mn: 0.07%, Al: 0.009%, S: 0.004%, Sb: 0.02%, B: 0.0022%, N: 0.0075%, and the balance substantially Fe and incidental impurities.

These steel slabs were heated to 1390° C. and were rough-rolled into sheet bars 35 mm thick, followed by finish rolling into sheets 2.2 mm thick, wherein one group of sheet bars was finish-rolled at a finish temperature of 965° C., while the other group was finish-rolled at a finish temperature of 1055° C. The steel sheets were then rapidly cooled by a water jet at a cooling rate of 50° C./s and were coiled at 570° C., whereby hot-rolled steel sheets were obtained.

The hot-rolled steel sheets were then subjected to hot-rolled sheet annealing consisting of heating up to 1100° C. at a heating rate of 15° C./s and holding at that temperature for 30 seconds, followed by pickling and subsequent cold rolling down to an intermediate sheet thickness of 1.5 mm. Then, intermediate annealing was conducted.

In this intermediate annealing, the steel sheets were held for 60 seconds at 1080° C., rapid-cooled by a spray of water mist at a cooling rate of 40° C./s, and were held for 30 seconds at 350° C. to cause precipitation of carbides.

Then, the steel sheets were rolled by a Senszimir mill at temperatures between 150° and 230° C. while being subjected to inter-pass aging of 10 to 30 minutes, into final cold-rolled thickness of 0.22 mm.

Each cold-rolled steel sheet thus obtained was subjected to degreasing, followed by a treatment for attaining finer magnetic domains in which grooves of 50 $\mu$m wide and 20 $\mu$m deep, extending at an angle of 15° to the breadth of the steel sheet, were formed at a pitch of 4 mm as measured in the longitudinal direction of the steel sheet. The steel sheet was then subjected to decarburization/primary recrystallization annealing conducted at 850° C. for 2 minutes. Then, an annealing separator composed of MgO containing 0.22% of Ca and 0.08% of B, with addition of 7.5% $TiO_2$ and 3% of $SnO_2$ was applied to the steel sheet which was then coiled. The steel sheet was then subjected to final finish annealing comprising heating up to 850° C. in an $N_2$ atmosphere at a heating rate of 30° C./h, holding at 850° C. for 25 hours, heating from 850° C. to 1150° C. in an atmosphere consisting of 25% $N_2$ and 75% $H_2$ at a heating rate of 15° C./h and holding the sheet at this temperature in an $H_2$ atmosphere for 5 hours, and subsequent cooling.

Then, after removal of unreacted annealing separator, a tension coating containing 50% colloidal silica was applied and baked to the sheet, whereby the product sheet was obtained.

Magnetic properties of the thus-obtained product sheets were measured; the results are shown in Table 14.

As will be sen from Table 14, extremely low levels of core loss are exhibited by the steel sheets of the present invention which were produced through processes in which the finish hot-rolling finish temperature T meet the condition of $745+35X+3Y \leqq T \leqq 900+35X+3Y$, heretofore discussed in this specification.

EXAMPLE 8

Five slabs having the composition RVII shown in Table 12 were prepared and heated to 1400° C. Each slab was subjected to a series of steps including rough rolling into a sheet bar 50 mm thick, finish rolling down to 2.7 mm thick at a rolling finish temperature of 1030° C., cooling at a cooling rate of 40° C./s by spraying cooling water, and coiling at 600° C.

The hot-rolled steel sheet was subjected to hot-rolled sheet annealing consisting of heating up to 1100° C. at a heating rate of 17° C./s and holding at this temperature for 60 seconds. Then, after pickling, the sheet was cold-rolled into a final cold-rolled thickness of 0.30 mm. Subsequently, degreasing was executed followed by subsequent decarburization/primary recrystallization annealing conducted at 850° C. for 2 minutes.

Then, final finish annealing was conducted after application of annealing separator of compositions RA to RE under annealing atmosphere conditions shown in Table 6. In the final finish annealing, $N_2$ atmosphere was employed while the steel sheets were heated up to 400° C. The heat pattern of this annealing was such that the steel sheets were heated to 1200° C. at a heating rate of 25° C./s and held at this temperature for 8 hours, followed by cooling.

After final finish annealing, unreacted annealing separator was removed from each coil and aluminum phosphate containing 50% colloidal silica was applied and baked to each coil at 800° C. Then, a treatment for obtaining finer magnetic domains was conducted by applying a plasma jet at a pitch of 7 mm, whereby the product sheets were obtained.

Magnetic properties of the thus-obtained steel sheets were measured. The results are shown in Table 15.

As will be seen from Table 15, all the steel sheets which meet the requirements of the present invention exhibited extremely low levels of core loss.

EXAMPLE 9

A silicon steel slab, having a composition containing C: 0.07%, Si: 3.35%, Mn: 0.07%, Al: 0.012%, Sb: 0.02%, N: 0.008%, B: 0.0015% and the balance substantially Fe and incidental impurities, was heated to 1330° C., and was subjected to a series of steps including rough hot rolling into a sheet bar of 45 mm thick at 1200° C., finish hot rolling down to 2.2 mm thick at a finish temperature of 1025° C., cooling at a cooling rate of 55° C./s by spraying cooling water, and coiling at 580° C., whereby a hot-rolled steel sheet was obtained. The steel sheet thus obtained was divided into three parts. The first part was subjected to a hot-rolled sheet annealing consisting of heating up to 1050° C. at a heating rate of 10.5° C./s and soaking at this temperature for 30 seconds (Steel of Invention 1). The second part was subjected to hot-rolled sheet annealing consisting of heating up to 1050° C. at a heating rate of 20.3° C./s and soaking at this temperature for 30 seconds (Steel of Invention 2). The third part was subjected to a hot-rolled sheet annealing consisting of heating up to 1050° C. at a heating rate of 33° C./s and soaking at this temperature for 30 seconds (Comparative Example). Then, after pickling, the sheet was cold-rolled into a sheet 0.34 mm thick.

Each steel sheet was subjected to degreasing treatment and subsequent decarburization/primary recrystallization annealing conducted at 820° C. for 2 minutes. Then, an annealing separator composed of 50% of $Al_2O_3$, 30% of CaO, 15% of MgO and 5% of $SrSO_4$ was applied to the steel sheet. The steel sheet was then subjected to final finish annealing having the steps of heating up to 800° C. in an $N_2$ atmosphere at a heating rate of 30° C./h, heating from 800° C. to 1050° C. in an atmosphere consisting of 25% $N_2$ and 75% $H_2$ at a heating rate of 12.5° C./h, heating from 1050° C. to 1200° C. at a heating rate of 25° C./h and 6-hour holding at this temperature in an $H_2$ atmosphere, and subsequent cooling in which an $H_2$ atmosphere was used until the temperature came down to 600° C., and an $N_2$ atmosphere was employed for further cooling down from 600° C. The steel sheets after this final finish annealing had no oxide on their surfaces, and base iron surfaces were exposed after removal of the annealing separator. The surfaces of the steel sheets were lightly pickled, and an insulator coat composed mainly of magnesium phosphate was applied to the surfaces of the steel sheets. Then, a plasma jet was applied at a pitch of 7 mm, whereby a product sheet was obtained for each part of the steel sheets.

These product sheets were subjected to measurement of magnetic properties. The results are shown below.

| | Magnetic flux density $B_8$ (T) | Core loss $W_{17/50}$ (W/Kg) |
|---|---|---|
| Invention 1 | 1.963 | 1.114 |
| Invention 2 | 1.960 | 1.119 |
| Comparative Example | 1.925 | 1,233 |

Thus, the steel sheets of Invention 1 and Invention 2 exhibited much lower levels of core loss as compared with the steel sheet of the Comparative Example.

TABLE 1

| COILS | HOT ROLL FINISH TEMP. (°C.) | HOT ROLLED SHEET ANNEAL TEMP (°C.) | AVERAGE GRAIN SIZE (mm) | MAGNETIC FLUX DENSITY $B_8$ (T) | CORE LOSS $W_{17/50}$ (W/kg) | REMARKS |
|---|---|---|---|---|---|---|
| PA-1 | 1050 | 1110 | 6.8 | 1.986 | 0.765 | GOOD |
| PA-2 | | 1170 | 25.7 | 1.543 | 1.954 | NOT GOOD |
| PB-1 | 950 | 1110 | 22.3 | 1.925 | 0.825 | NOT GOOD |
| PB-2 | | 1170 | 38.6 | 1.935 | 0.843 | KNOWN METHOD |

TABLE 2

| COILS | HOT ROLL FINISH TEMP. (°C.) | HOT ROLLED SHEET ANNEAL TEMP (°C.) | AVERAGE GRAIN SIZE (mm) | MAGNETIC FLUX DENSITY $B_8$ (T) | CORE LOSS $W_{17/50}$ (W/kg) | REMARKS |
|---|---|---|---|---|---|---|
| RA-1 | 1020 | 1100 | 6.8 | 1.936 | 0.815 | GOOD |
| RA-2 | | 1170 | 25.7 | 1.562 | 1.938 | NOT GOOD |
| RB-1 | 935 | 1100 | 22.3 | 1.895 | 0.935 | NOT GOOD |
| RB-2 | | 1170 | 38.6 | 1.905 | 0.906 | NOT GOOD |

TABLE 3

FDT VS B8

| SAMPLE NO. | X (%) | Y PPM | Z PPM | max (Y,3Z) | 610 + max (Y,3Z) + 35X | 900 + max (Y,3Z) + 40X | HOT ROLL FINISH TEMP. (°C.) | B8/Bs | REMARKS |
|---|---|---|---|---|---|---|---|---|---|
| 1 | 2.72 | 52 | 26 | 78 | 783.2 | 1086.8 | 872 | 0.924 | <950° C. |
| 2 | 2.55 | 30 | 22 | 66 | 765.25 | 1068 | 983 | 0.958 | SUITABLE |
| 3 | 2.62 | 42 | 18 | 56 | 757.7 | 1060.8 | 1082 | 0.931 | HIGH TEMP. |
| 4 | 2.42 | 43 | 17 | 51 | 745.7 | 1047.8 | 958 | 0.984 | SUITABLE |
| 5 | 2.35 | 55 | 32 | 96 | 788.25 | 1090 | 800 | 0.938 | <950° C. |
| 6 | 2.53 | 63 | 29 | 87 | 785.55 | 1088.2 | 975 | 0.968 | SUITABLE |
| 7 | 2.54 | 52 | 30 | 90 | 788.9 | 1091.6 | 1125 | 0.924 | HIGH TEMP. |
| 8 | 2.75 | 48 | 23 | 69 | 775.25 | 1079 | 1020 | 0.988 | SUITABLE |
| 9 | 2.52 | 70 | 32 | 96 | 794.2 | 1096.8 | 760 | 0.925 | <950° C. |
| 10 | 3.02 | 54 | 27 | 81 | 796.7 | 1101.8 | 895 | 0.942 | <950° C. |
| 11 | 3.07 | 70 | 33 | 99 | 816.45 | 1121.8 | 983 | 0.975 | SUITABLE |
| 12 | 3.25 | 25 | 18 | 54 | 777.75 | 1084 | 1100 | 0.924 | HIGH TEMP. |
| 13 | 3.45 | 50 | 24 | 72 | 802.75 | 1110 | 1052 | 0.963 | SUITABLE |
| 14 | 3.15 | 75 | 35 | 105 | 825.25 | 1131 | 1123 | 0.953 | SUITABLE |
| 15 | 2.95 | 80 | 40 | 120 | 833.25 | 1138 | 1100 | 0.962 | SUITABLE |
| 16 | 3.35 | 90 | 45 | 135 | 862.25 | 1169 | 1160 | 0.942 | >1150° C. |
| 17 | 2.85 | 90 | 42 | 126 | 835.75 | 1140 | 1132 | 0.957 | SUITABLE |
| 18 | 2.57 | 155 | 12 | 155 | 854.95 | 1157.8 | 1025 | 0.983 | SUITABLE |
| 19 | 3.25 | 175 | 8 | 175 | 898.75 | 1205 | 1178 | 0.928 | >1150° C. |
| 20 | 3.45 | 190 | 12 | 190 | 920.75 | 1228 | 995 | 0.975 | SUITABLE |
| 21 | 2.57 | 225 | 20 | 225 | 924.95 | 1227.8 | 1182 | 0.923 | >1150° C. |
| 22 | 3.32 | 232 | 5 | 232 | 958.2 | 1264.8 | 1135 | 0.967 | SUITABLE |
| 23 | 3.45 | 253 | 11 | 253 | 983.75 | 1291 | 973 | 0.940 | LOW. TEMP. |

TABLE 4

| CONDITIONS | ANNEALING SEPARATOR: B CONTENT IN MgO AGENT (%) | ANNEALING SEPARATOR: Ca CONTENT IN MgO AGENT (%) | ANNEALING SEPARATOR: $TiO_2$ CONTENT (%) | FINAL FINISH ANNEALING ATOMOSPHERE ($H_2$ CONTENT %, BALANCE $N_2$): 400~700°C. | 700~900°C. | 900~1050°C. | 1050~1180°C. | 1180°C. | COOLING | CONDITIONS OF INVENTION MET OR NOT |
|---|---|---|---|---|---|---|---|---|---|---|
| PA | 0.08 | 0.54 | 7.3 | 0 | 0 | 0 | 0 | 100 | $H_2$ | NOT MET |
| PB | | | | 0 | 0 | 0 | 75 | | ATMOSPHERE | NOT MET |
| PC | | | | 0 | 0 | 75 | 100 | | DOWN TO | MET |
| PD | | | | 0 | 25 | 50 | 75 | | 600° C., | MET |
| PE | | | | 25 | 50 | 75 | 100 | | FOL-LOWED | MET |
| PF | 0.02 | 0.12 | 6.5 | 0 | 50 | 75 | 100 | 100 | BY $N_2$ | MET |
| PG | 0.05 | 0.23 | 7.5 | | | | | | ATMOSPHERE | MET |
| PH | 0.07 | 0.005 | 8.0 | | 25 | 90 | 100 | 100 | | NOT MET |
| PI | 0.10 | 0.06 | 0.5 | | | | | | | NOT MET |
| PJ | 0.08 | 0.08 | 8.5 | | | | | | | MET |

TABLE 5

| CONDITIONS | AVERAGE GRAIN SIZE (mm) | MAGNETIC FLUX DENSITY $B_8$ (T) | CORE LOSS $W_{17/50}$ (W/kg) | REMARKS |
|---|---|---|---|---|
| PA | 25.3 | 1.872 | 1.735 | N |
| PB | 15.6 | 1.918 | 1.364 | N |

TABLE 5-continued

| CONDITIONS | AVERAGE GRAIN SIZE (mm) | MAGNETIC FLUX DENSITY $B_8$ (T) | CORE LOSS $W_{17/50}$ (W/kg) | REMARKS |
|---|---|---|---|---|
| PC | 7.3 | 1.975 | 0.953 | Y |
| PD | 6.5 | 1.982 | 0.948 | Y |

TABLE 5-continued

| CONDITIONS | AVERAGE GRAIN SIZE (mm) | MAGNETIC FLUX DENSITY $B_8$ (T) | CORE LOSS $W_{17/50}$ (W/kg) | REMARKS |
|---|---|---|---|---|
| PE | 7.3 | 1.978 | 0.950 | Y |
| PF | 8.7 | 1.976 | 0.952 | Y |
| PG | 6.4 | 1.975 | 0.967 | Y |
| PH | 8.3 | 1.965 | 1.089 | N |
| PI | 9.5 | 1.954 | 1.122 | N |
| PJ | 5.8 | 1.984 | 0.974 | Y |

N: DOES NOT MEET CONDITIONS OF INVENTION
Y: MEET CONDITIONS OF INVENTION

TABLE 7-continued

| CONDITIONS | AVERAGE GRAIN SIZE (mm) | MAGNETIC FLUX DENSITY $B_8$ (T) | CORE LOSS $W_{17/50}$ (W/kg) | REMARKS |
|---|---|---|---|---|
| RE | 7.3 | 1.949 | 0.952 | Y |
| RF | 8.7 | 1.948 | 0.989 | Y |
| RG | 6.4 | 1.955 | 0.962 | Y |
| RH | 8.3 | 1.945 | 0.985 | Y |
| RI | 9.5 | 1.954 | 0.982 | Y |
| RJ | 5.6 | 1.954 | 0.964 | Y |

N: DOES NOT MEET CONDITIONS OF INVENTION
Y: MEET CONDITIONS OF INVENTION

TABLE 6

| | ANNEALING SEPARATOR | | | FINAL FINISH ANNEALING ATMOSPHERE ($H_2$ CONTENT %, BALANCE $N_2$) | | | | | | |
|---|---|---|---|---|---|---|---|---|---|---|
| CONDITIONS | B CONTENT IN MgO AGENT (%) | Ca CONTENT IN MgO AGENT (%) | $TiO_2$ CONTENT (%) | 400~700°C. | 700~900°C. | 900~1050°C. | 1050~1180°C. | 1180°C. | COOLING | CONDITIONS OF INVENTION MET OR NOT |
| RA | 0.07 | 0.35 | 8.5 | 0 | 0 | 0 | 0 | 100 | $H_2$ | NOT MET |
| RB | | | | 0 | 0 | 0 | 75 | | ATMOSPHERE | NOT |
| RC | | | | 0 | 0 | 75 | 100 | | DOWN TO | MET |
| RD | | | | 0 | 25 | 50 | 75 | | 600° C., | MET |
| RE | | | | 25 | 50 | 75 | 100 | | FOLLOWED | MET |
| RF | 0.02 | 0.10 | 7.5 | 0 | 50 | 75 | 100 | 100 | BY $N_2$ | MET |
| RG | 0.05 | 0.25 | 7.5 | | | | | | ATMOSPHERE | MET |
| RH | 0.07 | 0.005 | 9.0 | | 25 | 85 | 100 | 100 | | MET |
| RI | 0.12 | 0.08 | 0.5 | | | | | | | MET |
| RJ | 0.08 | 0.08 | 8.5 | | | | | | | MET |

TABLE 7

| CONDITIONS | AVERAGE GRAIN SIZE (mm) | MAGNETIC FLUX DENSITY $B_8$ (T) | CORE LOSS $W_{17/50}$ (W/kg) | REMARKS |
|---|---|---|---|---|
| RA | 28.7 | 1.865 | 1.836 | N |
| RB | 17.5 | 1.903 | 1.384 | N |
| RC | 7.3 | 1.955 | 0.953 | Y |
| RD | 6.5 | 1.957 | 0.948 | Y |

TABLE 8

| | COMPSITIONS | | | | | | | | | | | | | | | | ** COMPOSITION RANGE |
|---|---|---|---|---|---|---|---|---|---|---|---|---|---|---|---|---|---|
| | Wt (%) | | | | | | | | | | | | | | (wt ppm) | | |
| STEELS | C | Si | Mn | P | AI | S | Sb | Sn | Cr | Bi | Cu | Se | Te | Mo | B | N | MET OR NOT |
| PI | 0.072 | 3.35 | 0.06 | 0.004 | 0.008* | 0.005 | tr | 0.01 | 0.01 | tr | 0.01 | tr | tr | tr | 0.5 | 83 | NOT MET |
| PII | 0.075 | 3.29 | 0.07 | 0.011 | 0.018 | 0.005 | tr | 0.01 | 0.02 | tr | 0.01 | tr | tr | tr | 2.0 | 85 | MET |
| PIII | 0.076 | 3.34 | 0.07 | 0.003 | 0.021 | 0.016 | 0.02 | 0.01 | 0.01 | tr | 0.02 | tr | tr | tr | 3.2 | 76 | MET |
| PIV | 0.082 | 3.36 | 0.06 | 0.008 | 0.018 | 0.003 | 0.02 | 0.01 | 0.02 | tr | 0.13 | 0.021 | tr | 0.010 | 4.3 | 69 | MET |
| PV | 0.072 | 3.38 | 0.07 | 0.009 | 0.019 | 0.004 | tr | 0.01 | 0.01 | tr | 0.01 | tr | tr | tr | 2.2 | 25* | NOT MET |
| PVI | 0.076 | 3.25 | 0.07 | 0.005 | 0.027 | 0.007 | tr | 0.01 | 0.25 | tr | 0.01 | tr | tr | tr | 3.4 | 81 | MET |
| PVII | 0.062 | 3.42 | 0.07 | 0.010 | 0.023 | 0.006 | 0.01 | 0.01 | 0.02 | 0.008 | 0.01 | tr | tr | tr | 4.2 | 75 | MET |
| PVIII | 0.078 | 3.34 | 0.06 | 0.008 | 0.022 | 0.003 | 0.026 | 0.02 | 0.01 | tr | 0.15 | tr | 0.012 | 0.010 | 3.3 | 89 | MET |
| PIX | 0.074 | 3.37 | 0.06 | 0.012 | 0.016 | 0.002* | tr | 0.02 | 0.02 | tr | 0.01 | tr | tr | tr | 2.3 | 75 | NOT MET |
| PX | 0.068 | 3.05 | 0.07 | 0.004 | 0.023 | 0.004 | tr | 0.01 | 0.08 | tr | 0.01 | tr | tr | 0.012 | 1.4 | 72 | MET |
| PXI | 0.074 | 3.26 | 0.07 | 0.005 | 0.025 | 0.006 | tr | 0.13 | 0.02 | tr | 0.01 | 0.015 | tr | tr | 2.2 | 77 | MET |
| PXII | 0.063 | 3.19 | 0.06 | 0.007 | 0.026 | 0.002 | tr | 0.01 | 0.02 | tr | 0.11 | 0.005 | 0.015 | tr | 1.5 | 84 | MET |
| PXIII | 0.083 | 3.25 | 0.07 | 0.009 | 0.024 | 0.009 | tr | 0.02 | 0.01 | 0.005 | 0.02 | 0.019 | tr | tr | 1.7 | 89 | MET |

TABLE 8-continued

| | COMPSITIONS | | | | | | | | | | | | | | | | ** COMPOSITION |
|---|---|---|---|---|---|---|---|---|---|---|---|---|---|---|---|---|---|
| | Wt (%) | | | | | | | | | | | | | | (wt ppm) | | RANGE |
| STEELS | C | Si | Mn | P | AI | S | Sb | Sn | Cr | Bi | Cu | Se | Te | Mo | B | N | MET OR NOT |
| PXIV | 0.077 | 3.28 | 0.06 | 0.008 | 0.019 | 0.005 | 0.037 | 0.02 | 0.01 | tr | 0.10 | 0.020 | tr | tr | 2.4 | 82 | MET |
| PXV | 0.079 | 3.34 | 0.07 | 0.007 | 0.025 | 0.018 | tr | 0.01 | 0.02 | tr | 0.02 | tr | tr | tr | 1.5 | 84 | MET |

Note:
The mark * indicates that the content falls out of range of invention.
The mark ** indicates that the full title is "COMPOSITION RANGE OF INVENTION MET OR NOT MET".

TABLE 9

| | MAGNETIC PROPERTIES | | |
|---|---|---|---|
| STEELS | MAGNETIC FLUX DENSITY $B_8$ (T) | CORE LOSS $W_{17/50}$ (W/kg) | REMARKS |
| PI | 1.853 | 1.453 | COMPARATIVE EXAMPLE |
| PII | 1.968 | 0.849 | INVENTION |
| PIII | 1.976 | 0.832 | INVENTION |
| PIV | 1.982 | 0.805 | INVENTION |
| PV | 1.827 | 1.325 | COMPARATIVE EXAMPLE |
| PVI | 1.965 | 0.851 | INVENTION |
| PVII | 1.980 | 0.822 | INVENTION |
| PVIII | 1.978 | 0.818 | INVENTION |
| PIX | 1.883 | 0.975 | COMPARATIVE EXAMPLE |
| PX | 1.978 | 0.838 | INVENTION |
| PXI | 1.975 | 0.835 | INVENTION |
| PXII | 1.980 | 0.843 | INVENTION |
| PXIII | 1.978 | 0.824 | INVENTION |
| PXIV | 1.982 | 0.807 | INVENTION |
| PXV | 1.976 | 0.802 | INVENTION |

TABLE 10

| SLABS | HOT ROLL FINISH TEMP. (°C.) | MAGNETIC FLUX DENSITY $B_8$ (T) | CORE LOSS $W_{17/50}$ (W/kg) | REMARKS |
|---|---|---|---|---|
| Pa | 985 | 1.946 | 0.698 | INVENTION |
| | 1090 | 1.850 | 0.704 | INVENTION |
| Pb | 985 | 1.853 | 0.897 | COMPARATIVE EXAMPLE |
| | 1090 | 1.862 | 0.964 | COMPARATIVE EXAMPLE |
| Pc | 985 | 1.852 | 0.948 | COMPARATIVE EXAMPLE |
| | 1090 | 1.963 | 0.693 | INVENTION |
| Pd | 985 | 1.958 | 0.682 | INVENTION |
| | 1090 | 1.868 | 0.894 | COMPARATIVE EXAMPLE |

TABLE 11

| CONDI-TIONS | MAGNETIC FLUX DENSITY $B_8$ | CORE LOSS $W_{17/50}$ (W/kg) | REMARKS |
|---|---|---|---|
| PA | 1.875 | 1.124 | COMPARATIVE EXAMPLE |
| PB | 1.887 | 1.068 | COMPARATIVE EXAMPLE |
| PC | 1.975 | 0.852 | INVENTION |
| PD | 1.982 | 0.843 | INVENTION |
| PE | 1.978 | 0.867 | INVENTION |
| PF | 1.956 | 0.993 | COMPARATIVE EXAMPLE |
| PG | 1.980 | 0.848 | INVENTION |
| PH | 1.953 | 0.987 | COMPARATIVE EXAMPLE |
| PI | 1.962 | 0.995 | COMPARATIVE EXAMPLE |
| PJ | 1.977 | 0.864 | INVENTION |

TABLE 12

| STEELS | COMPOSITIONS (Wt %) C | Si | Mn | P | AI | S | Sb | Sn | Cr | Bi | Cu | Se | TE | MO | (wt ppm) B | N | COMPOSITION RANGE OF INVENTION MET OR NOT MET |
|---|---|---|---|---|---|---|---|---|---|---|---|---|---|---|---|---|---|
| RI | 0.072 | 3.42 | 0.06 | 0.004 | 0.008 | *0.002 | tr | 0.01 | 0.01 | tr | 0.01 | *tr | tr | tr | *0.5 | 86 | NOT MET |
| RII | 0.076 | 3.25 | 0.07 | 0.013 | 0.008 | 0.005 | tr | 0.01 | 0.01 | tr | 0.01 | tr | tr | tr | *5.6 | 82 | NOT MET |
| RIII | 0.074 | 3.31 | 0.07 | 0.003 | 0.012 | 0.012 | 0.02 | 0.01 | 0.01 | tr | 0.02 | tr | tr | tr | *5.2 | 84 | NOT MET |
| RIV | 0.069 | 3.28 | 0.06 | 0.008 | 0.014 | 0.002 | 0.02 | 0.01 | 0.02 | tr | 0.13 | 0.019 | tr | 0.012 | 8.3 | 79 | MET |
| RV | 0.083 | 3.38 | 0.07 | 0.009 | 0.011 | 0.004 | tr | 0.01 | 0.01 | tr | 0.01 | tr | tr | tr | 10.2 | *25 | NOT MET |
| RVI | 0.074 | 3.34 | 0.07 | 0.005 | 0.007 | 0.007 | tr | 0.01 | 0.25 | tr | 0.01 | tr | tr | tr | 15.4 | 85 | MET |
| RVII | 0.066 | 3.39 | 0.07 | 0.010 | 0.004 | 0.016 | 0.011 | 0.01 | 0.02 | 0.007 | 0.01 | tr | tr | tr | 9.2 | 68 | MET |
| RVIII | 0.076 | 3.27 | 0.07 | 0.005 | 0.012 | 0.013 | 0.026 | 0.02 | 0.01 | tr | 0.12 | tr | 0.010 | 0.011 | 33 | 82 | MET |
| RIX | 0.082 | 3.33 | 0.06 | 0.014 | 0.008 | 0.002 | tr | 0.02 | 0.02 | tr | 0.01 | 0.006 | tr | tr | 63 | 77 | MET |
| RX | 0.076 | 3.18 | 0.07 | 0.003 | 0.004 | 0.004 | tr | 0.01 | 0.08 | tr | 0.02 | tr | tr | 0.008 | 10.2 | 70 | MET |
| RXI | 0.070 | 3.41 | 0.06 | 0.012 | 0.018 | 0.006 | tr | 0.13 | 0.02 | tr | 0.02 | 0.015 | tr | tr | 27 | 88 | MET |
| RXII | 0.079 | 3.09 | 0.07 | 0.008 | 0.014 | 0.014 | tr | 0.01 | 0.02 | tr | 0.01 | tr | tr | tr | 32 | 74 | MET |
| RXIII | 0.075 | 3.37 | 0.06 | 0.010 | 0.006 | 0.009 | tr | 0.02 | 0.01 | 0.006 | 0.01 | 0.017 | tr | tr | 48 | 69 | MET |
| RXIV | 0.067 | 3.17 | 0.07 | 0.004 | 0.017 | 0.005 | 0.037 | 0.02 | 0.01 | tr | 0.15 | 0.022 | tr | tr | 25 | 80 | MET |
| RXV | 0.080 | 3.41 | 0.06 | 0.005 | 0.004 | 0.018 | tr | 0.01 | 0.02 | tr | 0.01 | tr | tr | tr | 46 | 76 | MET |

Note: The mark * indicates that content falls out of range of invention.

TABLE 13

| STEELS | MAGNETIC PROPERTIES MAGNETIC FLUX DENSITY $B_8$ | CORE LOSS $W_{17/50}$ (W/kg) | REMARKS |
|---|---|---|---|
| RI | 1.862 | 1.449 | COMPARATIVE EXAMPLE |
| RII | 1.843 | 1.523 | COMPARATIVE EXAMPLE |
| RIII | 1.820 | 1.605 | COMPARATIVE EXAMPLE |
| RIV | 1.963 | 0.867 | INVENTION |
| RV | 1.818 | 1.489 | COMPARATIVE EXAMPLE |
| RVI | 1.953 | 0.846 | INVENTION |
| RVII | 1.949 | 0.848 | INVENTION |
| RVIII | 1.965 | 0.868 | INVENTION |
| RIX | 1.954 | 0.840 | INVENTION |
| RX | 1.966 | 0.865 | INVENTION |
| RXI | 1.953 | 0.832 | INVENTION |
| RXII | 1.975 | 0.873 | INVENTION |
| RXIII | 1.958 | 0.839 | INVENTION |
| RXIV | 1.967 | 0.859 | INVENTION |
| RXV | 1.961 | 0.825 | INVENTION |

TABLE 14

| SLABS | HOT ROLL FINISH TEMP. (°C.) | MAGNETIC FLUX DENSITY $B_8$ (T) | CORE LOSS $W_{17/50}$ (W/kg) | REMARKS |
|---|---|---|---|---|
| Ra | 965 | 1.925 | 0.732 | INVENTION |
| | 1055 | 1.883 | 0.864 | COMPARATIVE EXAMPLE |
| Rb | 965 | 1.864 | 0.885 | COMPARATIVE EXAMPLE |
| | 1055 | 1.924 | 0.685 | INVENTION |
| Rc | 965 | 1.845 | 0.922 | COMPARATIVE EXAMPLE |
| | 1055 | 1.928 | 0.674 | INVENTION |
| Rd | 965 | 1.930 | 0.712 | INVENTION |
| | 1055 | 1.924 | 0.707 | INVENTION |

TABLE 15

| CONDITIONS | MAGNETIC FLUX DENSITY $B_8$ (T) | CORE LOSS $W_{17/50}$ (W/kg) | REMARKS |
|---|---|---|---|
| RA | 1.845 | 1.137 | COMPARATIVE EXAMPLE |
| RB | 1.856 | 1.116 | COMPARATIVE EXAMPLE |
| RC | 1.954 | 0.863 | INVENTION |
| RD | 1.962 | 0.860 | INVENTION |
| RE | 1.959 | 0.867 | INVENTION |

What is claimed is:

1. A method of producing a grain-oriented magnetic steel sheet exhibiting a very low core loss and high magnetic flux density, which method includes preparing a silicon steel slab having a composition comprising C: from about 0.025 to 0.095 wt %, Si: from about 1.5 to 7.0 wt %, Mn: from about 0.03 to 2.5 wt %, S and/or Se: from about 0.003 to 0.0400 wt %, a nitride inhibitor component comprising Al: from about 0.010 to 0.030 wt % and/or B: from about 0.0008 to 0.0085 wt %, and N: from about 0.0030 to 0.0100 wt %; heating said slab to a temperature not lower than about 1300° C.; hot-rolling said slab, hot-rolled sheet annealing said slab, rapidly cooling the resulting steel sheet after said hot rolling, at a cooling rate that is not less than about 20° C./s and coiling the resulting sheet at a temperature not higher than about 670° C. followed by cold rolling into a final cold-rolled sheet thickness, conducting primary recrystallizing annealing, application of an annealing separator and final finish annealing;

wherein said cold rolling being single-stage cold rolling down to final cold-rolled thickness in a single step at a rolling reduction of from about 80 to 95%;

wherein said hot rolling is executed such that the cumulative rolling reduction at said finish hot rolling ranges from about 85 to 99% and such that the finish temperature of said finish hot rolling ranges from about 950° to 1150° C. and substantially meets the condition of the following equation (1):

$$610+35X+\max(Y, 3Z) \leqq T \leqq 900+40X+\max(Y, 3Z) \quad (1)$$

where T represents the finish temperature of the finish hot rolling (°C.), X represents the Si content (wt %), Y represents the Al content (wt ppm), Z represents the B content (wt ppm) and max(Y, 3Z) represents the maximum value of either the Al content or three times the B content;

wherein said hot-rolled sheet annealing being conducted under such conditions that said steel sheet is heated to about 800° C. at an average heating rate of from about 5° to 25° C./s and held for a period not longer than about 150 seconds at a temperature ranging from about 800° to 1125° C.;

and wherein said final finish annealing being executed in an $H_2$-containing atmosphere at least after said steel sheet temperature has reached about 900° C. in the course of heating of said steel sheet.

2. A method according to claim 1, characterized in that said nitride inhibitor component comprises Al: from about 0.010 to 0.030 wt % and N: from about 0.003 to 0.010 wt %; and wherein said slab is heated to a temperature not lower than about 1350° C. prior to hot rolling;

and wherein the finish temperature of finish hot rolling meets the condition of the following equation (2):

$$610+40X+Y \leqq T \leqq 750+40X+Y \quad (2)$$

and wherein the holding temperature of said hot-rolled sheet annealing ranges from about 900° to 1125° C.; and wherein said annealing separator comprises about 1 to 20 wt % of Ti compound and about 0.01 to 3.0 wt % of Ca compound.

3. A method according to claim 1, characterized in that said nitride inhibitor component comprises B: from about 0.0008 to 0.0085 wt % and N: from about 0.003 to 0.010 wt %;

said slab is heated to a temperature not lower than 1350° C. prior to hot rolling;

and wherein the finish temperature of finish hot rolling meets the condition of the following equation (3):

$$745+35X+3Z \leqq T \leqq 900+35X+3Z \quad (3)$$

and wherein the holding temperature of said hot-rolled sheet annealing ranges from about 900° to 1125° C.

4. A method according to claim 1, wherein the cooling in the annealing which immediately precedes the cold rolling is conducted so rapidly as to increase the content of dissolved C.

5. A method according to claim 4, wherein said cold rolling comprises warm rolling conducted at a temperature ranging from about 90° to 350° C. or wherein inter-pass aging is conducted in place of said cold rolling at a temperature ranging from about 100° to 300° C. for about 10 to 60 minutes.

6. A method according to any one of claims 1–5, wherein said annealing immediately preceding cold rolling comprises decarburization by an amount of 0.005 to 0.025 wt %.

7. A method according to claim 2, wherein the cooling in the annealing which immediately precedes the final cold rolling is conducted so rapidly as to increase the content of dissolved C.

8. A method according to claim 3, wherein the cooling in the annealing which immediately precedes the final cold rolling is conducted so rapidly as to increase the content of dissolved C.

9. A method of producing a grain-oriented magnetic steel sheet exhibiting a very low core loss and high magnetic flux density, which method includes preparing a silicon steel slab having a composition comprising C: from about 0.025 to 0.095 wt %, Si: from about 1.5 to 7.0 wt %, Mn: from about 0.03 to 2.5 wt %, S and/or Se: from about 0.003 to 0.0400 wt %, a nitride inhibitor component comprising Al: from about 0.010 to 0.030 wt % and/or B: from about 0.0008 to 0.0085 wt %, and N: from about 0.0030 to 0.0100 wt %; heating said slab to a temperature not lower than about 1300° C.; hot-rolling said slab, hot-rolled sheet annealing said slab, rapidly cooling the resulting steel sheet after said hot rolling, at a cooling rate that is not less than about 20° C./s and coiling the resulting sheet at a temperature not higher than about 670° C., followed by cold rolling into a final cold-rolled sheet thickness, conducting primary recrystallizing annealing, application of an annealing separator and final finish annealing;

wherein said cold rolling being two-stage cold rolling with intermediate annealing, said two-stage cold rolling utilizing a first step comprising a rolling reduction of from about 15 to 60% and a second step after intermediate annealing comprising a rolling reduction of from about 80 to 95% into the final cold-rolled sheet thickness;

wherein hot rolling is executed such that the cumulative rolling reduction at said finish hot rolling ranges from about 85 to 99% and such that the finish temperature of said finish hot rolling ranges from about 950° to 1150° C. and substantially meets the condition of the following equation (1):

$$610+35X+\max(Y, 3Z) \leqq T \leqq 900+40X+\max(Y, 3Z) \quad (1)$$

where T represents the finish temperature of the finish hot rolling (°C.), X represents the Si content (wt %), Y represents the Al content (wt ppm), Z represents the B content (wt ppm) and max(Y, 3Z) represents the maximum value of either the Al content or three times the B content;

wherein both said hot-rolled sheet annealing and said intermediate sheet annealing being conducted under such conditions that said steel sheet is heated to about 800° C. at an average heating rate of from about 5° to 25° C./s and held for a period not longer than about 150 seconds at a temperature ranging from about 800° to 1125° C.;

and wherein said final finish annealing being executed in an $H_2$-containing atmosphere at least after said steel sheet temperature has reached about 900° C. in the course of heating of said steel sheet.

10. A method according to claim 9, characterized in that said nitride inhibitor component comprises Al: from about 0.010 to 0.030 wt % and N: from about 0.003 to 0.010 wt %;

wherein said slab is heated to a temperature not lower than about 1350° C. prior to hot rolling;

wherein the finish temperature of finish hot rolling meets the condition of the following equation (2):

$$610+40X+Y \leqq T \leqq 750+40X+Y \quad (2);$$

wherein the holding temperature of both said hot-rolled sheet annealing and said intermediate annealing ranges from about 900° to 1125° C.;

and wherein said annealing separator comprises about 1 to 20 wt % of Ti compound and about 0.01 to 3.0 wt % of Ca compound.

11. A method according to claim 9, characterized in that said nitride inhibitor component comprises B: from about 0.0008 to 0.0085 wt % and N: from about 0.003 to 0.010 wt %;

said slab is heated to a temperature not lower than 1350° C. prior to hot rolling;

wherein the finish temperature of finish hot rolling meets the condition of the following equation (3):

$$745+35X+3Z \leqq T \leqq 900+35X+3Z \quad (3);$$

and wherein the holding temperature of both said hot-rolled sheet annealing and said intermediate annealing ranges from about 900° to 1125° C.

12. A method according to claim 9, wherein the cooling in the annealing which immediately precedes the second step of said two-stage cold rolling is conducted so rapidly as to increase the content of dissolved C.

13. A method according to claim 12, wherein said second step of said two-stage cold rolling comprises warm rolling conducted at a temperature ranging from about 90° to 350° C. or wherein inter-pass aging is conducted in place of said second step of said two-stage cold rolling at a temperature ranging from about 100° to 300° C. for about 10 to 60 minutes.

14. A method according to any one of claims 1–5, wherein said annealing immediately preceding the second step of said two-stage cold rolling comprises decarburization by an amount of 0.005 to 0.025 wt %.

15. A method according to claim 10, wherein the cooling in the annealing which immediately precedes the second step of said two-stage cold rolling is conducted so rapidly as to increase the content of dissolved C.

16. A method according to claim 11, wherein the cooling in the annealing which immediately precedes the second step of said two-stage cold rolling is conducted so rapidly as to increase the content of dissolved C.

17. A method of producing a grain-oriented magnetic steel sheet exhibiting a very low core loss and high magnetic flux density, which method includes preparing a silicon steel slab having a composition comprising C: from about 0.025 to 0.095 wt %, Si: from about 1.5 to 7.0 wt %, Mn: from about 0.03 to 2.5 wt %, S and/or Se: from about 0.003 to 0.0400 wt %, a nitride inhibitor component comprising Al: from about 0.010 to 0.030 wt % and/or B: from about 0.0008 to 0.0085 wt %, and N: from about 0.0030 to 0.0100 wt %; heating said slab to a temperature not lower than about 1300° C.; hot-rolling said slab, rapidly cooling the resulting steel sheet after said hot rolling, at a cooling rate that is not less than about 20° C./s and coiling the resulting sheet at a temperature not higher than about 670° C., followed by cold rolling into a final cold-rolled sheet thickness, conducting primary recrystallizing annealing, application of an annealing separator and final finish annealing;

wherein said cold rolling being two-stage cold rolling with intermediate annealing, said two-stage cold rolling utilizing a first step comprising a rolling reduction of from about 15 to 60% and a second step after intermediate annealing comprising a rolling reduction of from about 80 to 95% into the final cold-rolled sheet thickness;

wherein said hot rolling is executed such that the cumulative rolling reduction at said finish hot rolling ranges from about 85 to 99% and such that the finish temperature of said finish hot rolling ranges from about 950° to 1150° C. and substantially meets the condition of the following equation (1):

$$610+35X+\max(Y, 3Z) \leqq T \leqq 900+40X+\max(Y, 3Z) \quad (1)$$

where T represents the finish temperature of the finish hot rolling (°C.), X represents the Si content (wt %), Y represents the Al content (wt ppm), Z represents the B content (wt ppm), and max(Y, 3Z) represents the maximum value of either the Al content or three times the B content;

wherein said intermediate sheet annealing being conducted under such conditions that said steel sheet is heated to about 800° C. at an average heating rate of from about 5° to 25° C./s and held for a period not longer than about 150 seconds at a temperature ranging from about 800° to 1125° C.;

and wherein said final finish annealing being executed in an $H_2$-containing atmosphere at least after said steel sheet temperature has reached about 900° C. in the course of heating of said steel sheet.

18. A method according to claim 17, characterized in that said nitride inhibitor component comprises Al: from about 0.010 to 0.030 wt % and N: from about 0.003 to 0.010 wt %;

wherein said slab is heated to a temperature not lower than about 1350° C. prior to hot rolling;

wherein the finish temperature of finish hot rolling meets the condition of the following equation (2):

$$610+40X+Y \leqq T \leqq 750+40X+Y \quad (2);$$

and wherein the holding temperature of said intermediate annealing ranges from about 900° to 1125° C.;

and wherein said annealing separator comprises about 1 to 20 wt % of Ti compound and about 0.01 to 3.0 wt % of Ca compound.

19. A method according to claim 17 characterized in that said nitride inhibitor component comprises B: from about 0.0008 to 0.0085 wt % and N: from about 0.003 to 0.010 wt %;

said slab is heated to a temperature not lower than 1350° C. prior to hot rolling;

wherein the finish temperature of finish hot rolling meets the condition of the following equation (3):

$$745+35X+3Z \leqq T \leqq 900+35X+3Z \quad (3)$$

and wherein the holding temperature of intermediate annealing ranges from about 900° to 1125° C.

20. A method according to claim 17 wherein the cooling in the annealing which immediately precedes the second step of said two-stage cold rolling is conducted so rapidly as to increase the content of dissolved C.

21. A method according to claim 20, wherein said second step of said two-stage cold rolling comprises warm rolling conducted at a temperature ranging from about 90° to 350° C. or wherein inter-pass aging is conducted in place of said second step of said two-stage-cold rolling at a temperature ranging from about 100° to 300° C. for about 10 to 60 minutes.

22. A method according to any one of claims 1–5, wherein said annealing immediately preceding the second step of said two-stage cold rolling comprises decarburization by an amount of 0.005 to 0.025 wt %.

23. A method according to claim 18 wherein the cooling in the annealing which immediately precedes the second step of said two-stage cold rolling is conducted so rapidly as to increase the content of dissolved C.

24. A method according to claim 19, wherein the cooling in the annealing which immediately precedes the second step of said two-stage cold rolling is conducted so rapidly as to increase the content of dissolved C.

* * * * *

UNITED STATES PATENT AND TRADEMARK OFFICE

CERTIFICATE OF CORRECTION

PATENT NO. : 5,885,371
DATED : March 23, 1999
INVENTOR(S) : Komatsubara, et al

It is certified that error appears in the above-identified patent and that said Letters Patent is hereby corrected as shown below:

In Column 34, at Table 12, at the subheading "Se", on the first line, please change "*tr" to --tr--.

Signed and Sealed this

Seventh Day of September, 1999

*Attest:*

Q. TODD DICKINSON

*Attesting Officer*

*Acting Commissioner of Patents and Trademarks*